US012497794B1

(12) United States Patent
Hillyard

(10) Patent No.: US 12,497,794 B1
(45) Date of Patent: Dec. 16, 2025

(54) CONVERTIBLE LID FOR POOL DECKS

(71) Applicant: Waterway Plastics, Oxnard, CA (US)

(72) Inventor: Jason Hillyard, Oxnard, CA (US)

( * ) Notice: Subject to any disclaimer, the term of this patent is extended or adjusted under 35 U.S.C. 154(b) by 315 days.

(21) Appl. No.: 18/117,867

(22) Filed: Mar. 6, 2023

Related U.S. Application Data

(60) Provisional application No. 63/317,398, filed on Mar. 7, 2022.

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 4/496, 498
See application file for complete search history.

(56) References Cited

U.S. PATENT DOCUMENTS

| | | | | |
|---|---|---|---|---|
| 2,900,101 | A | 8/1959 | Clark | |
| 3,199,713 | A | 8/1965 | Flachbarth | |
| 3,378,858 | A * | 4/1968 | Candido | E04H 4/1236 210/166 |
| 4,061,434 | A | 12/1977 | Carroll | |
| 5,088,246 | A | 2/1992 | Brown | |
| 5,123,776 | A | 6/1992 | Lang | |
| 5,551,191 | A | 9/1996 | Maiwandi | |
| 6,209,586 | B1 | 4/2001 | Wright | |
| 6,340,035 | B2 | 1/2002 | Wright | |
| 6,393,771 | B1 | 5/2002 | Stetson | |
| 6,393,774 | B1 | 5/2002 | Stetson | |
| 6,557,588 | B2 | 5/2003 | Wright | |
| 7,076,813 | B2 | 7/2006 | Stetson | |
| 7,451,570 | B1 | 11/2008 | Gavin | |
| 7,748,926 | B2 | 7/2010 | Jurich et al. | |
| 7,748,927 | B2 | 7/2010 | Neathery | |
| 7,788,743 | B2 | 9/2010 | Mjelde et al. | |
| 7,862,729 | B2 | 1/2011 | Stetson | |
| 9,428,900 | B2 * | 8/2016 | Wroblewski | E03F 5/0407 |
| D818,566 | S | 5/2018 | Freeman | |
| D819,788 | S | 6/2018 | Freeman | |
| 10,731,367 | B1 * | 8/2020 | Willwater | E04H 4/1272 |
| D958,930 | S | 7/2022 | Mjelde | |
| 11,643,832 | B1 * | 5/2023 | Mjelde | E04H 4/1236 4/504 |
| 2008/0272038 | A1 | 11/2008 | Stetson | |
| 2009/0321442 | A1 | 12/2009 | Stetson | |
| 2017/0120475 | A1 | 5/2017 | Freeman | |

* cited by examiner

*Primary Examiner* — Huyen D Le
(74) *Attorney, Agent, or Firm* — Sandy Lipkin

(57) ABSTRACT

A convertible lid for pool decks to cover access to the skimmer and any other plumbing and/or mechanics related to the pool. One side of the convertible lid is made of a plastic or other material that is easily liftable and recognizable as a lid cover. The other side is a fillable lid that can be filled with the same material as is used for the deck so that the lid blends into the deck and is not easily visible or recognizable. The single 10 lid can be used either way and is constructed to easily convert between the two types of coverings.

23 Claims, 23 Drawing Sheets

-PRIOR ART-

-PRIOR ART-

-PRIOR ART-

CONVERTIBLE LID FOR POOL DECKS

REFERENCE TO PRIOR APPLICATION

This application claims priority to the provisional patent application No. 63/317,398, filed on Mar. 7, 2022 entitled CONVERTIBLE LID FOR POOL DECKS by Jason Hillyard.

BACKGROUND OF THE INVENTION

Field of the Invention

The field of this invention relates generally to the field of pool deck lids and more particularly toward a deck lid that covers an in-ground pool skimmer, as well as other areas on a pool deck that are beneath an aperture that needs to be covered, that can convert between a non-fill side that is easily visible and recognizable as the lid and a second fillable side that can be filled with material that matches or otherwise coordinates with the pool deck such that the lid blends into the deck and is not easily visible and recognizable as the skimmer lid cover or is otherwise aesthetically matched.

Description of the Prior Art

Pool decks for in-ground pools have as part of their structure an aperture where the pool skimmer is located. Access to the skimmer through this aperture is covered typically by a lid. There are two types of lids currently used to cover up the skimmer aperture. A typical and cost-effective version is a plastic lid (or other material) that is the same shape as the aperture and placed atop the aperture. This type of lid is visibly obvious due to the material it is made of contrasting with the rest of the deck.

Higher end deck lids have a container structure with a center void that can be filled with the same material that the deck is composed of or a material that coordinates therewith. Examples of fill material could include, but is not limited to, concrete, mortar (including polymer cement mortar), stone, pavers, tiles and wood. This allows for a seamless or otherwise aesthetically-pleasing look where the lid is not obviously visible. In both types of lids, there is typically a means, such as finger or tool holes, that allow for the easy removal of the lid in order to access the skimmer through the aperture.

The state of the art presently is that a pool owner of a pool deck that is to be constructed or refurbished can choose between these two types of lids. It is the object of the instant invention to provide for a two-in-one convertible pool deck lid assembly from which a pool owner can elect to choose either version. One side of the lid includes the non-fill style of lid and the other side of the lid is fillable with deck or other material. The same lid can be acquired by a pool owner that does not plan to use the fill version or may change his or her mind later. This reduces the need for double inventory on the part of the manufacturer and throughout the supply chain and increases possible uses for the consumer. This also allows for replacement of a missing or damaged filled version of the lid with readily available replacement lid intended to fit the existing mounting ring without the need of having to use the filled side by using the non-filled style side of the lid.

SUMMARY OF THE INVENTION

The basic embodiment of the present invention teaches a convertible lid assembly for pool deck apertures comprising:

a convertible lid, said convertible lid further comprising: a first non-fillable side, said first non-fillable side further comprising: a center point; a substantially planar surface having a perimeter; a sidewall extending downward from said perimeter substantially perpendicular to said planar surface; and a non-slip surface; a second fillable side having a common perimeter with said first non-fillable side, said fillable side further comprising: a common perimeter with said first non-fillable side; a common center point with said first non-fillable side; a plurality of ribs to support said first non-fillable side wherein said sidewall has a consistent height around said perimeter to contain a fill material therein; a mounting ring with a common perimeter with said first non-fillable side and said second fillable side into which said sidewall seats wherein said mounting ring is configured for permanent placement in said pool deck aperture through pool deck material wherein said convertible lid is configured to removably cover said pool deck aperture.

The above embodiment can be further modified by defining that said first non-fillable side and second fillable side of said lid further comprise one or more retaining apertures for use with one or more retaining screws and wherein said mounting ring further comprises one or more apertures corresponding to said one or more retaining apertures in said first non-fillable side or said second fillable side for securing said lid with said one or more retaining screws.

The above embodiment can be further modified by defining that each of said one or more retaining apertures on said first non-fillable side interconnects to a respective one or more retaining apertures on said second fillable side each interconnected retaining aperture configured for use with one or more retaining screws to be used and accessed from either said first non-fillable side or said second fillable side of said convertible lid for attachment to said mounting ring.

The above embodiment can be further modified by defining that said one or more retaining apertures are configured such that said one or more retaining screws will have equal engagement with said one or more apertures in said mounting ring when said one or more retaining screws are installed from said first non-fillable side of said convertible lid or when said one or more retaining screws are installed from said second fillable side of said convertible lid.

The above embodiment can be further modified by defining that said second fillable side has at least one undercut to retain a fill material in said convertible lid.

An alternate embodiment of the instant invention teaches a convertible lid assembly for pool deck apertures comprising: a convertible lid, said convertible lid further comprising: a first non-fillable side, said first non-fillable side further comprising: a center point; a substantially planar surface having a perimeter; a sidewall extending downward from said perimeter substantially perpendicular to said planar surface; one or more apertures to be used as finger holes; and a non-slip surface; a second fillable side, said second fillable side further comprising: a common perimeter with said first non-fillable side; a common center point with said first non-fillable side; a sidewall with a consistent height to contain a fill material; and one or more apertures to be used as finger holes; a mounting ring with a common perimeter with said first non-fillable side and said second fillable side into which said sidewall seats wherein said mounting ring is configured for permanent placement in said pool deck aperture through pool deck material wherein said convertible lid is configured to removably cover said pool deck aperture.

The above embodiment can be further modified by defining that said first non-fillable side of said convertible lid further comprises one or more retaining apertures and wherein said mounting ring further comprises one or more apertures corresponding to said one or more retaining apertures on said first non-fillable side and said second fillable side for securing said convertible lid with said one or more retaining screws.

The above embodiment can be further modified by defining that each of said one or more retaining apertures on said first non-fillable side interconnects to a respective one or more retaining apertures on said second fillable side each said interconnecting retaining aperture configured for use with one or more retaining screws to be used and accessed from both said first non-fillable side and said second fillable side of said convertible lid for attachment to said mounting ring.

The above embodiment can be further modified by defining that said one or more of said one or more retaining apertures are usable from both said first non-fillable side and said second fillable side of the lid and are designed so said one or more screws will have substantially equal engagement with said one or more apertures in said mounting ring when said one or more retaining screws are installed from said first non-fillable side or when said one or more retaining screws are installed from said second fillable side of said convertible lid.

The above embodiment can be further modified by defining that each of said one or more apertures are to be used as finger holes on said first non-fillable side of said convertible lid and is interconnected to a respective aperture to be used as a finger hole on said second fillable side.

The above embodiment can be further modified by defining that one or more finger holds corresponding to said one or more interconnected apertures are to be used as finger holes wherein at least one of said one or more finger holds are for use from said first non-fillable side.

The above embodiment can be further modified by defining that one or more finger holds corresponding to said one or more interconnected apertures are to be used as finger holes wherein at least one of said one or more finger holds are for use from said second fillable side.

The above embodiment can be further modified by defining that one or more finger hold features corresponding to said one or more interconnected apertures are to be used as finger holes wherein at least one of said one or more finger hold features are for use from said first non-fillable side and said second fillable side.

The above embodiment can be further modified by defining that said second fillable side has at least one undercut to retain a fill material to said convertible lid.

An alternate embodiment of the instant invention teaches a convertible lid assembly for pool deck apertures comprising: a convertible lid, said convertible lid further comprising: a first non-fillable side, said first non-fillable side further comprising: a center point; a substantially planar surface having a perimeter; a sidewall extending downward from said perimeter substantially perpendicular to said planar surface; one or more apertures to be used as finger holes; and a non-slip surface; a second fillable side, said second fillable side further comprising: a common perimeter with said first non-fillable side; a common center point with said first non-fillable side; a plurality of ribs to support said first non-fillable side; a sidewall with a consistent height to contain a fill material; one or more apertures to be used as finger holes each of said one or more apertures to be used as finger holes in said second fillable side interconnects to a respective one or more apertures to be used as the finger holes on said first non-fillable side of the lid said one or more apertures to be used as finger holes on said second fillable side of said convertible lid has an entrance height at a same common height as said perimeter side wall; at least one undercut to retain a fill material to the lid; and a mounting ring with a common perimeter with said first non-fillable side and said second fillable side into which said sidewall seats wherein said mounting ring is configured for permanent placement in said pool deck aperture through pool deck material wherein said convertible lid is configured to removably cover said pool deck aperture.

The above embodiment can be further modified by defining that said first non-fillable side and said second fillable side of said convertible lid further comprising one or more retaining apertures for one or more retaining screws wherein said mounting ring further comprises one or more apertures corresponding to said one or more retaining apertures in said first non-fillable side and said second fillable side for securing said convertible lid with said one or more retaining screws, each of said one or more retaining apertures on SAID first non-fillable side interconnects to a respective one or more retaining apertures on SAID second fillable side, each interconnected retaining aperture configured for use with one of said one or more retaining screws to be used and accessed from both said first non-fillable side or said second fillable side of said convertible lid for attachment to said mounting ring.

The above embodiment can be further modified by defining that said one or more retaining apertures are at least partially located within said interconnected finger holes wherein said one or more retaining apertures are designed so said one or more screws will have substantially equal engagement with said one or more apertures in said mounting ring when said one or more retaining screws are installed from said first non-fillable side or when said one or more retaining screws are installed from said second fillable side of said convertible lid.

The above embodiment can be further modified by defining that one or more finger hold features corresponding to said one or more interconnected apertures are to be used as finger holes.

The above embodiment can be further modified by defining that a taper angle between said sidewall of said convertible lid and said common perimeter of said mounting ring is between zero and twelve degrees when either said first non-fillable side or said second fillable side of said convertible lid is viewable from said pool deck while located within said mounting ring.

The above embodiment can be further modified by defining that said non-slip surface of said first non-fillable side of said convertible lid employs individual non-slip features with no more than one inch spacing therebetween.

The above embodiment can be further modified by defining that said first non-fillable side of said convertible lid is receives a logo plate.

The above embodiment can be further modified by defining that said convertible lid is configured for the selection of said second fillable side wherein said logo plate substantially closes off windows in said convertible lid assembly to prevent fill material from migrating through said windows and falling out of said convertible lid during a filling process.

The above embodiment can be further modified by defining that said second fillable side of said convertible lid has a minimum depth of six hundred thousandths of an inch as measured from a distal end of said sidewall opposite said planar surface.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1C:
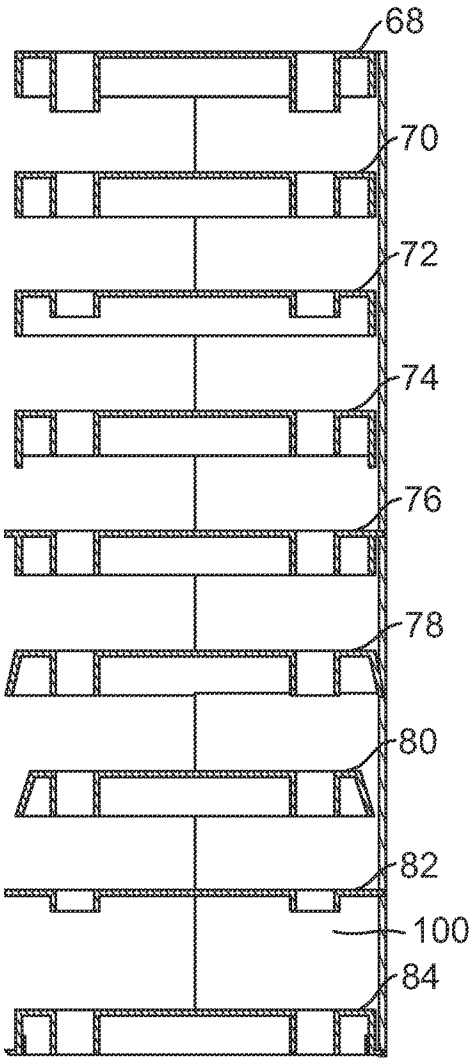
FIG. 1C is a side cutaway views of the same 9 prior art examples shown in FIGS. 1A-1B.

Turning to the drawings, the preferred embodiment is illustrated and described by reference characters that denote similar elements throughout the several views of the instant invention.

Figure 1B:
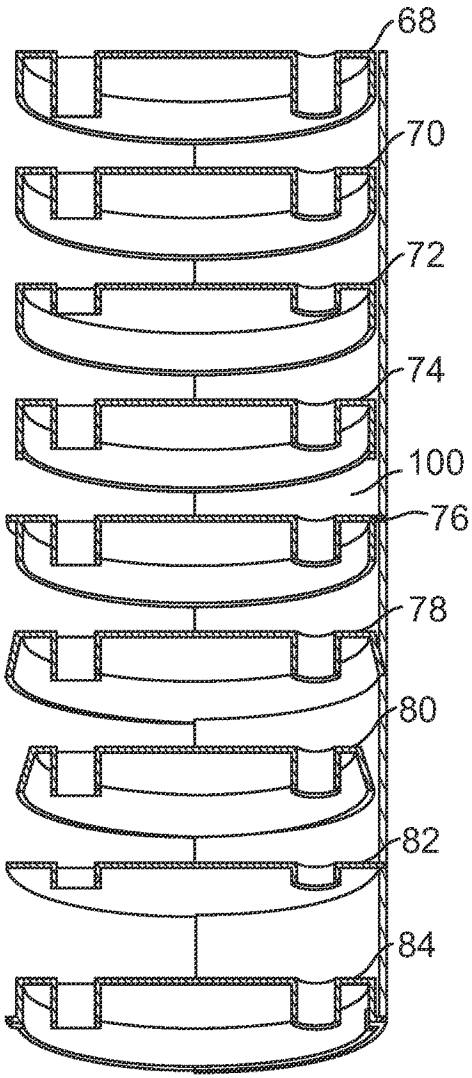
FIG. 1B is a bottom side perspective cutaway view of the same 9 prior art examples shown in FIG. 1A.
Figure 1A:
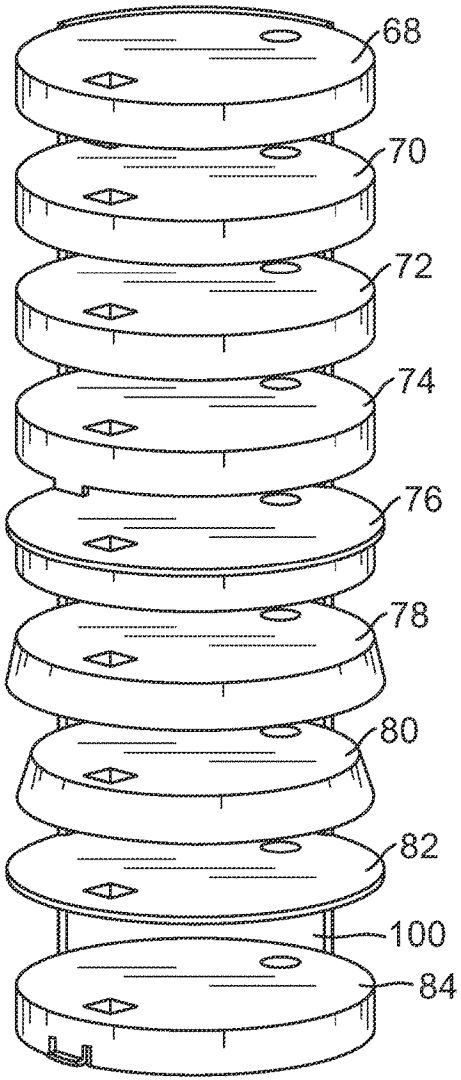
FIG. 1A is a is a top perspective view of 9 separate styles of prior art lids.
Figure 2:
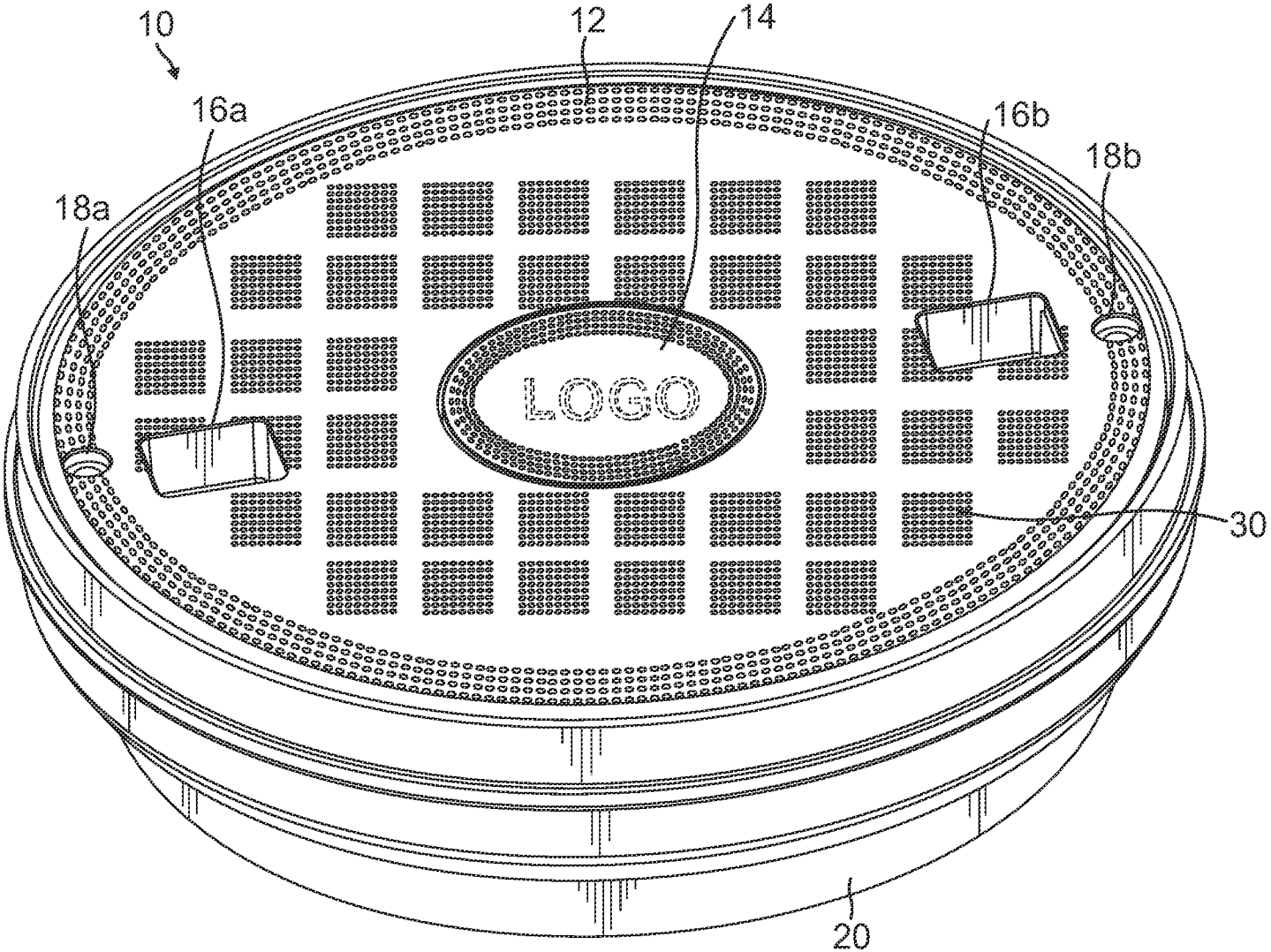
FIG. 2 is a top perspective view of the convertible lid assembly of the instant invention with the non-fill side exposed and showing the center receiving area to receive the optional center tab/logo plate.

FIGS. 1A-1C show various side views of 9 separate prior pool deck lids that are included to illustrate issues with the prior art that are being addressed by the instant invention. These views are included to emphasize that portions of the prior art that are not present in the instant invention that are absent and/or replaced with different structures in order to overcome the limitations of the prior art and to conform to the objects of the instant invention.

Each set of prior art lids shown in FIGS. 1A-1C are illustrated against a backdrop of a wall 100 to illustrate the boundary of the prior art devices or of the mounting ring that lid would be situated within to give a sense of the relational distance and to show that these prior art lids are either too large or have too much gap to fit properly into the mounting ring of the convertible lid assembly 10 of the instant invention. The optimal minimal taper angle 66 is described below in the instant invention to overcome these problems in the prior art.

In first exemplary lid 68, the finger hole walls or any other lid feature are too long to meet the object of the instant invention. The finger hole walls are taller than the height of the side wall and would present a trip hazard if used in the fill side orientation. Additionally, there is no finger hold point within the height of the side wall that falls within 0.600"-0.750" from either side of the lid. There is no finger hold point for both orientations of the lid.

In second exemplary lid 70, there is no finger hold point within the height of the side wall that falls within 0.750" from either side of the lid. Additionally, there is no finger hold point for both orientations of the lid. There is not a grip surface and there is no ribbing support to allow this embodiment to be used in a non-filled orientation.

In exemplary lid 72, the finger hole walls are too short to allow fill material to completely fill the bowl. There is only one finger hold point within the height of the side wall for the non-fill side that falls within 0.600"-0.750" from either side of the lid. There is no finger hold point for both orientations of the lid.

In exemplary lid 74 there is an extending long section along the side wall and no finger hold point for both orientations of the lid.

In exemplary lid 76 there is a flange extending outside of the side wall and no finger hold point for both orientations of the lid.

In exemplary lid 78 there is too much angle on the side wall that would interfere with the mounting ring of the assembly of the instant invention and there is no finger hold point for both orientations of the lid.

In exemplary lid 80 there is too much angle on the side wall that creates too much gap with the mounting ring of the convertible lid assembly of the instant invention when in the non-fill side up orientation. Additionally, there is no finger hold point for both orientations of the lid.

In exemplary lid 82 there is no side wall at all giving either a flange that is too large to fit into the mounting ring of the convertible lid assembly of the instant invention or a smaller version that may fit within the mounting ring of the convertible lid assembly of the instant invention would sit too low to be flush with the deck. Also, similar to exemplary lid 68 the lid is not intended to be turned over and used with the opposite side up and would pose a trip hazard if the lid orientation was flipped so that the extruded finger holes or other any lid features were to protrude above the level of the pool deck.

Exemplary lid 84 includes tabs extending from the side wall that prevent the complete filling of the fill-side of the convertible lid assembly of the instant invention. These tabs are larger than the mounting ring diameter of the convertible lid assembly of the instant invention. The is no finger hold point for both orientations of the lid.

All of these features will be further compared and contrasted with the detailed description of the instant invention below.

The preferred embodiment of the instant invention provides for a convertible lid assembly 10 that can be used in one of two orientations to cover the skimmer aperture on the pool deck 42 of an in-ground pool. A first orientation includes a non-fill side 12 typically made of plastic but which can be made of any suitable material. The non-fill side 12 would be visibly distinct from the pool deck 42 and easily located. An optional center tab 14 can be included into a recessed pocket 34 in the center of the lid assembly which can include a logo 38 of the manufacturer or any other decorative marking. On either side of the center of the lid, whether containing the center tab 14 or not, are a pair of finger holes 16*a*, 16*b* and a pair of apertures 18*a*, 18*b* for tightening screws which can be affixed to the mounting ring 20 into which the convertible lid seats in the pool deck 42. The screw holes 18*a*, 18*b* are offset from the center line of the finger holes 16*a*, 16*b* so that a user's fingers can easily still fit inside of the finger holes 16*a*, 16*b* despite the presence of the screw holes 18*a*, 18*b*.

The non-fill side 12 has a perimeter and can have a round shape, a square shape, an oval shape, or any other shape that would fit into a skimmer aperture design on a pool deck 42. Extending downward from the perimeter of the non-fill side 12 is a side wall 26 which fits into the mounting ring 20. There is an angle 66 between the side wall 26 and the mounting ring 20 that should be minimal and as small as possible to provide a snug and secure fit. This angle between the sidewall and the mounting ring should be between 0 and 12 degrees, preferably a minimum of 4 degrees. Furthermore, the sidewall of the lid is perpendicular to the non-fill side of the lid within +/−2 degrees. The sidewalls also should maintain their angle 66 relative to the hole they are being placed in regardless of the orientation of the lid.

Figure 3A:
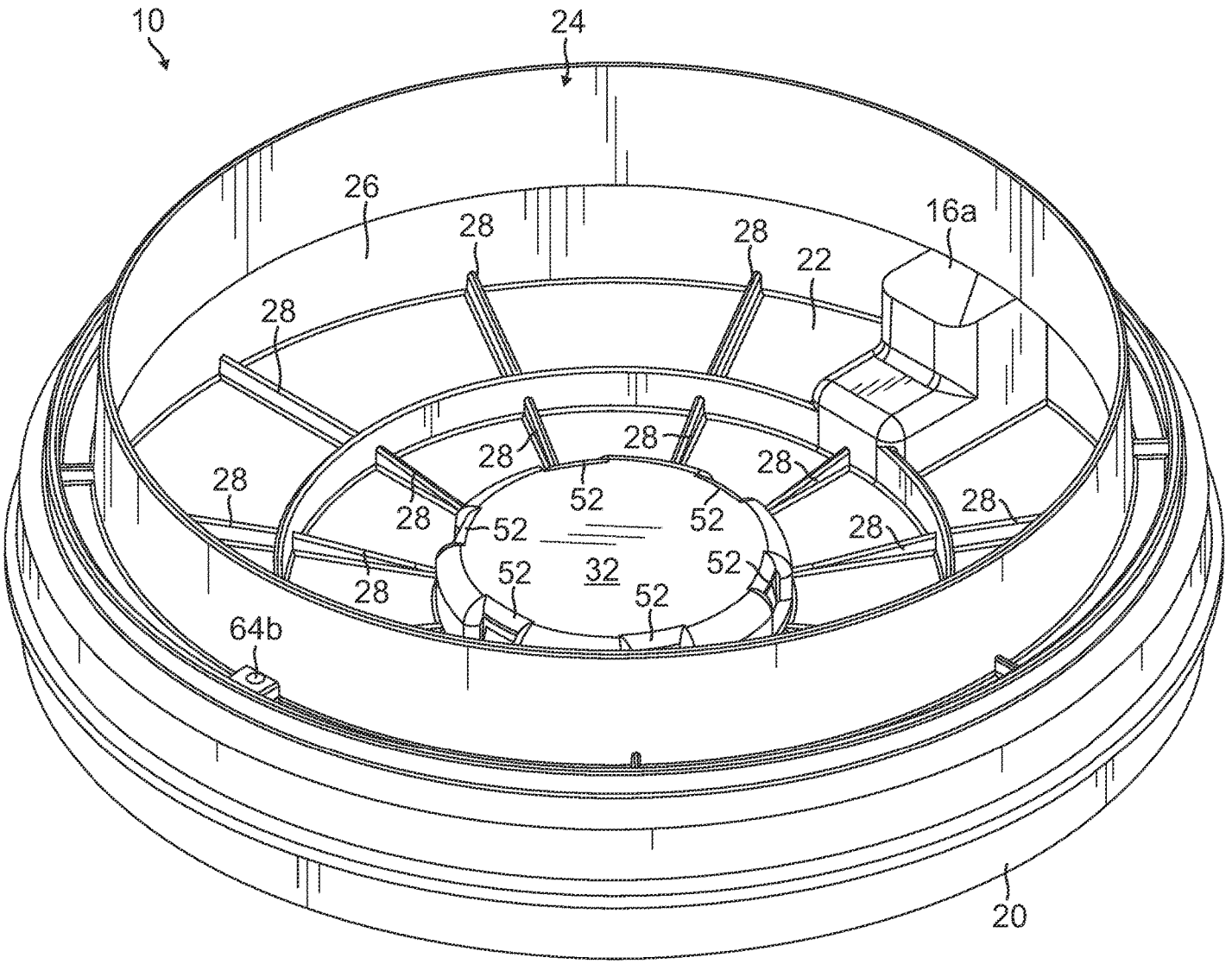
FIG. 3A is a top perspective view of the convertible lid assembly of the instant invention with the fill side exposed and unfilled.
Figure 5:
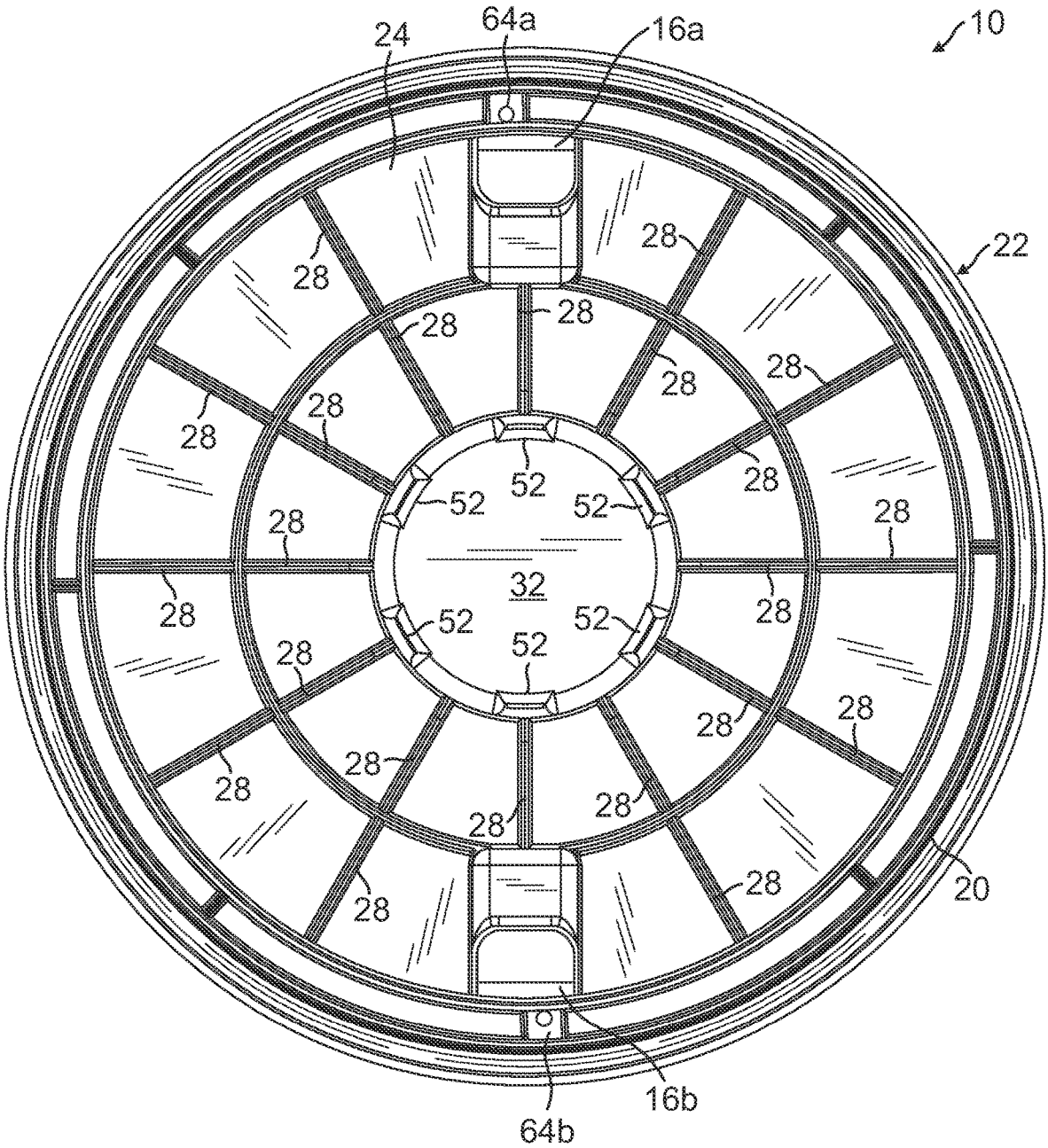
FIG. 5 is a bottom view of the non-fill side of the convertible lid assembly shown in FIG. 4 of the instant invention with the opposite, fill side exposed and unfilled.
Figure 6:
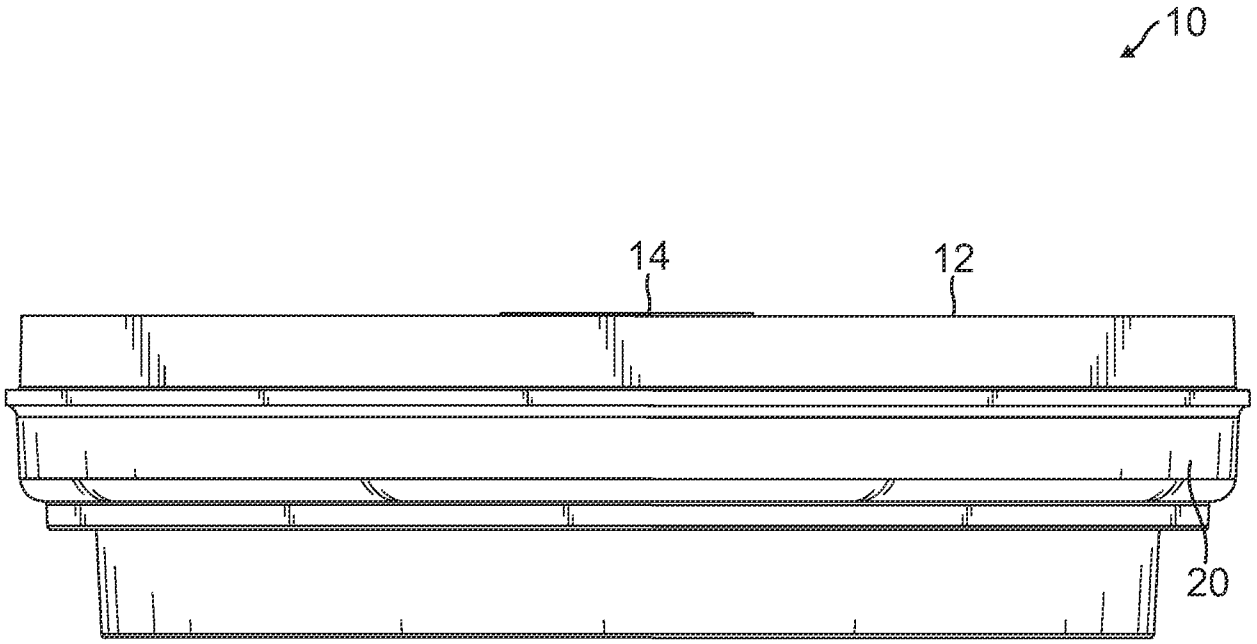
FIG. 6 is a side view of the convertible lid assembly of the instant invention with the non-fill side facing up.
Figure 7:
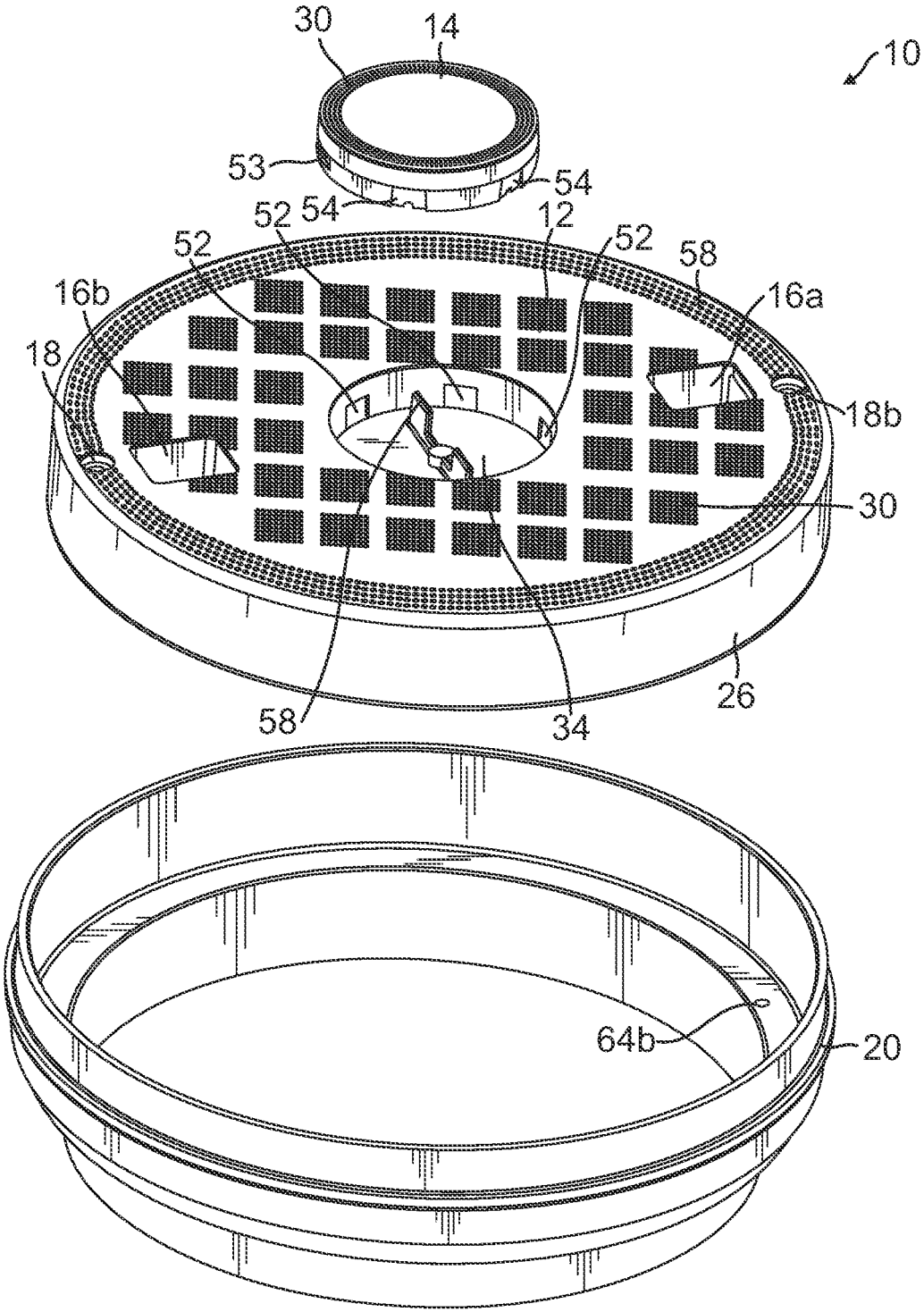
FIG. 7 is a top exploded view of the convertible lid assembly of the instant invention with the non-fill side facing up and including the optional center tab/logo plate as well as textured sections.
Figure 8:
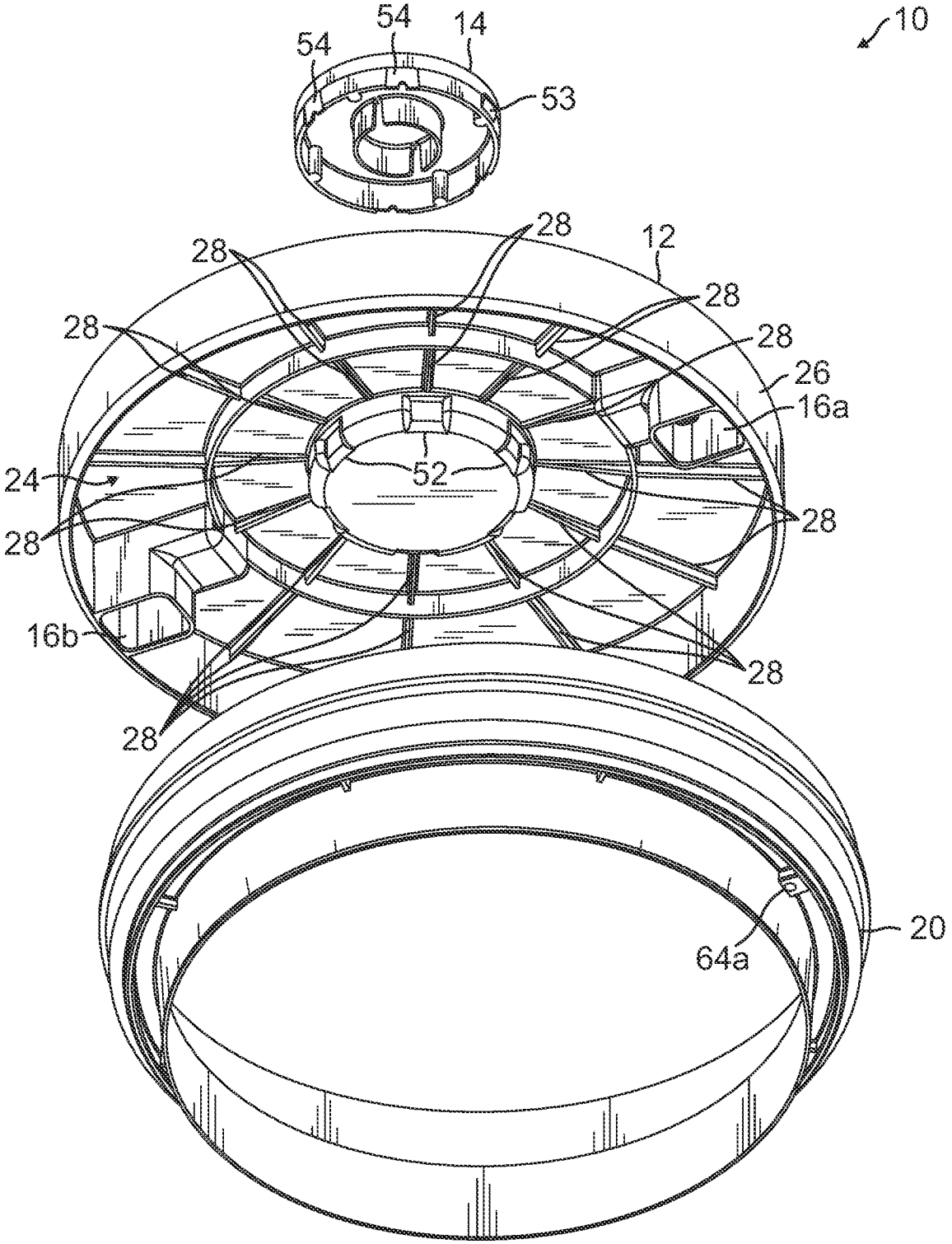
FIG. 8 is a bottom exploded view of the convertible lid assembly of the instant invention with the non-fill side facing up and including the optional center tab/logo plate.

On the opposite side of the non-fill side 12 is the fill, or bowl, side 22 which has a cavity 24 formed between the perimeter of the side wall 26. This cavity 24 can be filled with fill material to match or coordinate with the pool deck material 42. FIG. 3A and FIG. 5 show the structure of the fill side 24 when not filled and when including an insert 32 for receiving the optional center tab plate 14. Since the fill side 22 and cavity 24 may not be chosen as the side to use, i.e., the non-fill side 12 is face up, the bottom of the cavity 24 contains a plurality of ribs 28 that extend along the diameter of the cavity 24 extending to the sidewall 26. The ribs 28 support longer spans and ribs 28 no more than 4 inches apart. Ribs 28 may be straight arced and split into multiple ribs 28. Ribs 28 may follow paths other than from the center point to the perimeter wall 26. This provides structural support for the non-fill side 12 when elected for use and therefore not otherwise structurally supported by fill material.

Figure 10:
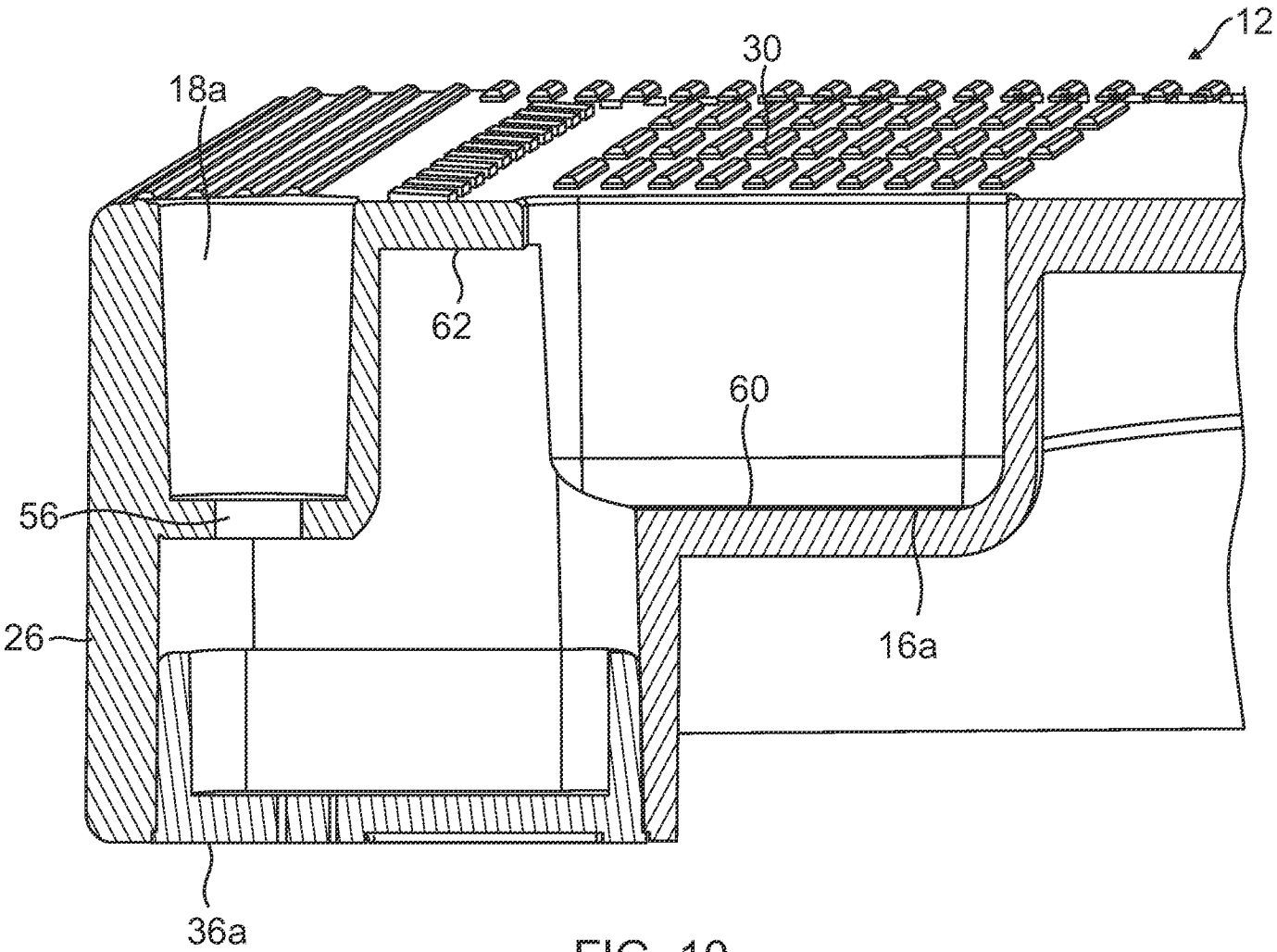
FIG. 10 is a close-up side cross-sectional view of the convertible lid assembly of the instant invention showing in close-up the screw-retaining section with the finger-hole of the non-fill side, which is face up, illustrating also both the square-shaped version of the assembly and the version of the no-fill side with a textured surface.

Inside the cavity 24 are seen the underside of the finger holes 16*a*, 16*b*. This underside forms an L-shape. This L-shaped provides that the finger hold action of these holes are accessible from either side of the lid assembly 10, depending upon which side is used. In either case, the side facing the interior of the lid assembly 10 is the finger hold side 60 and the other finger hold side 62 is adjacent the sidewall 26 and provides further structural support and integrity. When a user elects to remove the lid from either side, he or she puts his or her finger into the finger holes 16*a*, 16*b* and presses the finger against the appropriate finger hold. Finger hold side 60 is used for grip and assistance in lifting off the lid from the assembly 10 when accessed from the filled side. Finger hold side 62 is used for grip and assistance in lifting off the lid from the assembly 10 when accessed from the non-filled side. Alternatively, notches (not shown) could be included or holes (not shown) that are shaped that receive a tool for lifting the lid assembly 10 could also be included. The screw holes 18*a*, 18*b* allow for screws to be inserted therein and affixed to receiving holes 64*a*, 64*b* on the mounting ring 20. At the base of the screw holes 18*a*, 18*b* are retaining holes 56 for the screw, seen in side view in FIG. 10.

The L-shape of the finger holes 16*a*, 16*b*, regardless of which orientation is chosen, provides a structure with a ledge, the ledge being parallel to the top or the bottom, depending on the orientation and having a height of approximately half of the height of the sidewall 26 itself. The finger hold 60 from the fill side 22 should be a minimum depth of 0.600" to 0.750" so when it is located below where the fill material may be placed, the fill material is not so thin as to crack easily. Ideally, a single length screw secures the lid to the mounting ring 20, which requires positioning of the screw head retaining area of the lid to be located at a midpoint of the height of the lid. This leaves no extra length to extend further into the collar 20 screw receiving area which is a cylindrical cavity that has an approximate depth of ⅜". (See FIG. 10) If not for this, the mating fixture and deck material below the screw receiving area of the lid may block the screw from extending further and may cause the screw receiving area to fail as the thread formed area of the screw receiving area may be stripped out by the screw threads that are not driving lower in concert with the helical thread pitch because of positioning and presence of the mating fixture, deck material or other obstruction.

Prior art devices do not have the finger holes in the fill cavity, but rather, they are included in the sidewalls, which is not practical in the assembly 10 of the instant invention. In the device of the instant invention, the finger holes 16*a*, 16*b* have a height that matches the sidewall height, but are not found in the sidewall itself. Since the finger hole 16*a*, 16*b* height matches the sidewall height, no fill material should find its way inside of them.

There should be zero to limited taper on the sidewall 26, i.e., there should be a minimal angle 66 between the side wall 26 and the mounting ring. (See FIGS. 9A-9B). This is the portion of the assembly 10 where the lid and collar perimeters mate. If there were a taper on the lid, one side would fit well without a gap, but the other side would either have a noticeable gap or would be too large to fit. Prior art lids sometimes have a taper as seen in FIGS. 1A-1C, but in these devices, the design is not reversible so this is not a concern for those devices. However, in the case of the instant invention, since the lid is reversible, it is critical that there be negligible taper and a very small angle 66 between the side wall 26 and the mounting ring 20. This angle between the sidewall and the mounting ring should be between 0 and 12 degrees, preferably a minimum of 4 degrees. Furthermore, the sidewall of the lid is perpendicular to the non-fill side of the lid within +/−2 degrees. The sidewalls also should maintain their minimal angle 66 relative to the hole they are being placed in regardless of the orientation of the lid.

The device of the instant invention is designed so that in either orientation, there is a limited gap between the collar sidewalls and the lid sidewalls, e.g., 0.250" or less, so there is a substantially flat surface on the lid and a level transition to the collar and the area outside of the collar, the sidewalls of both the lid and the mounting ring having a uniform height.

As a further distinction over the lids previously mentioned that are not designed to be convertible, the device of the instant invention specifically has no flanges, no flange segments, no tabs or anything outside of the perimeter of the sidewall 26 that protrudes from the outside or outward from the main exterior shape defining the perimeter wall. A flange would get in the way of seating the lid in the collar in one orientation and in the other it would make for an oversized collar relative to the flange, which is undesirable. Prior art devices often have tapered sidewalls, which would be preferred in those cases when dealing with heavy lids. For this reason, these types of lids would not be suitable with the assembly 10 of the instant invention.

Figure 3B:
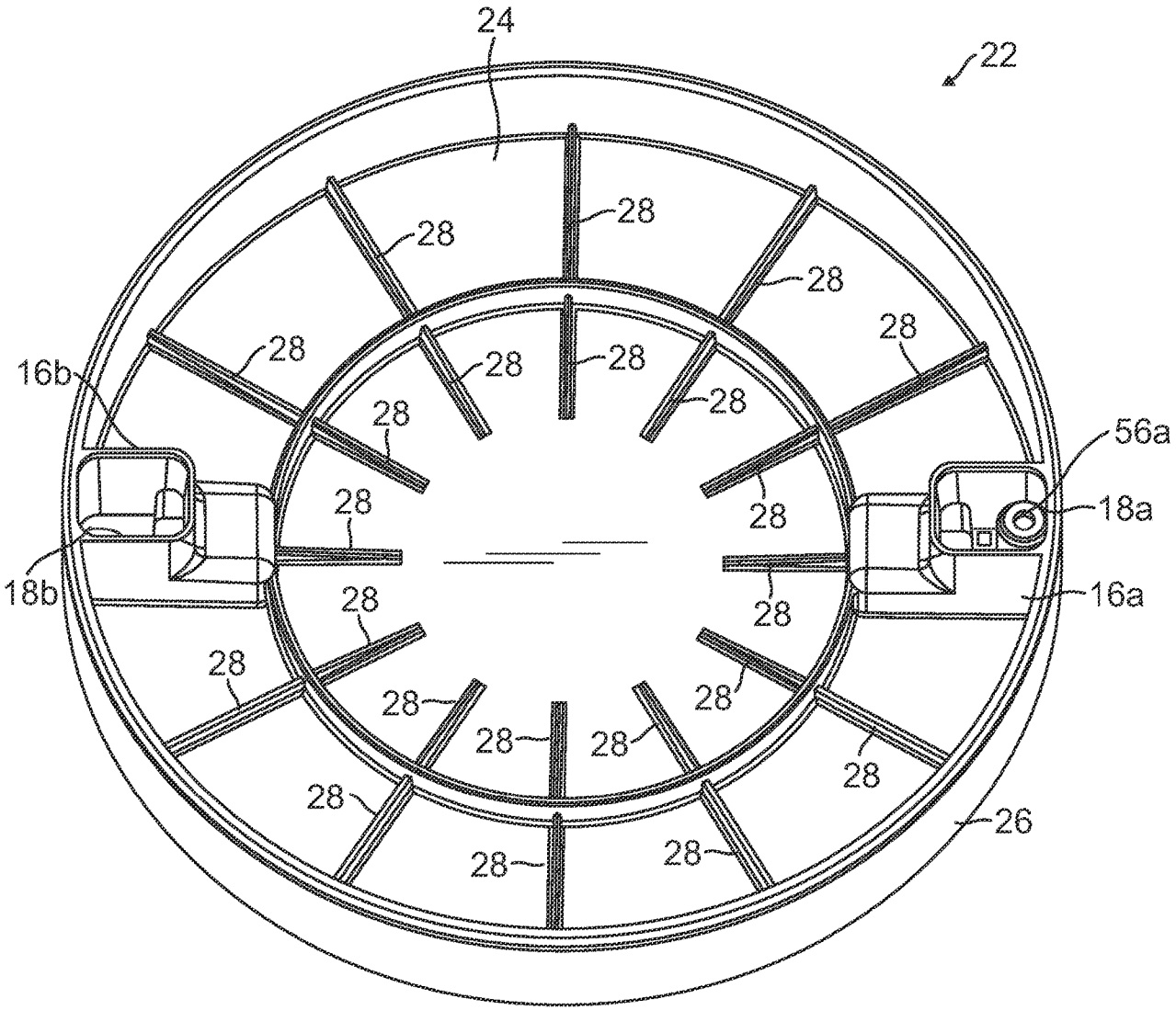
FIG. 3B is a top view of the convertible lid assembly of the instant invention with the fill side exposed and unfilled and without an area to receive the optional center tab/logo plate.
Figure 4:
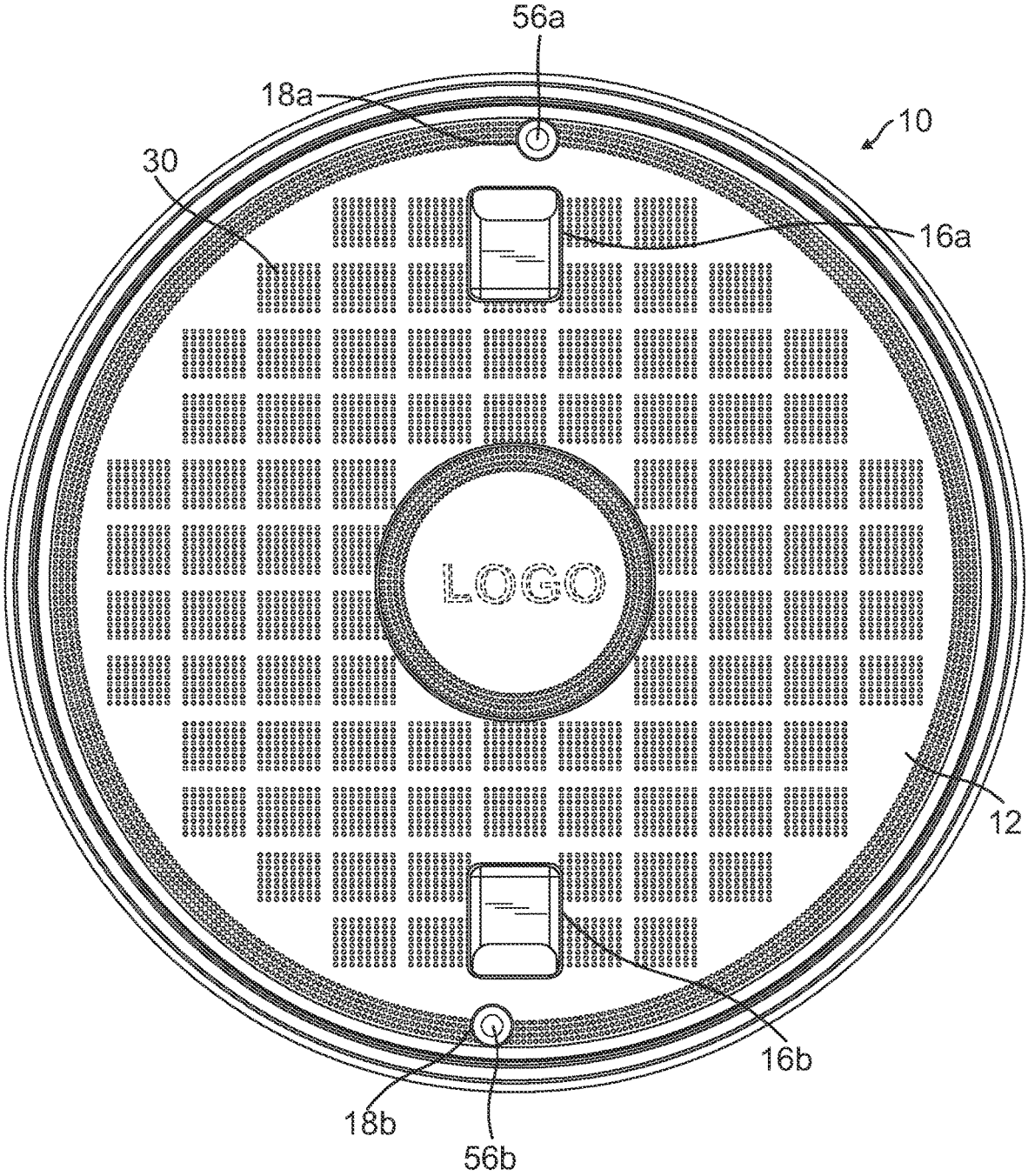
FIG. 4 is a top view of the convertible lid assembly of the instant invention with the non-fill side exposed without the optional center tab/logo plate and showing textured sections.

FIGS. 3B and 4 show a version without the optional center tab/logo plate 14. In this embodiment, the other elements remain, including the supporting ribs 28 in the cavity 24 of the fill side 22. This embodiment, seen from the top in FIG. 4 has a smooth look across the surface of the non-fill side 12.

Figure 11:
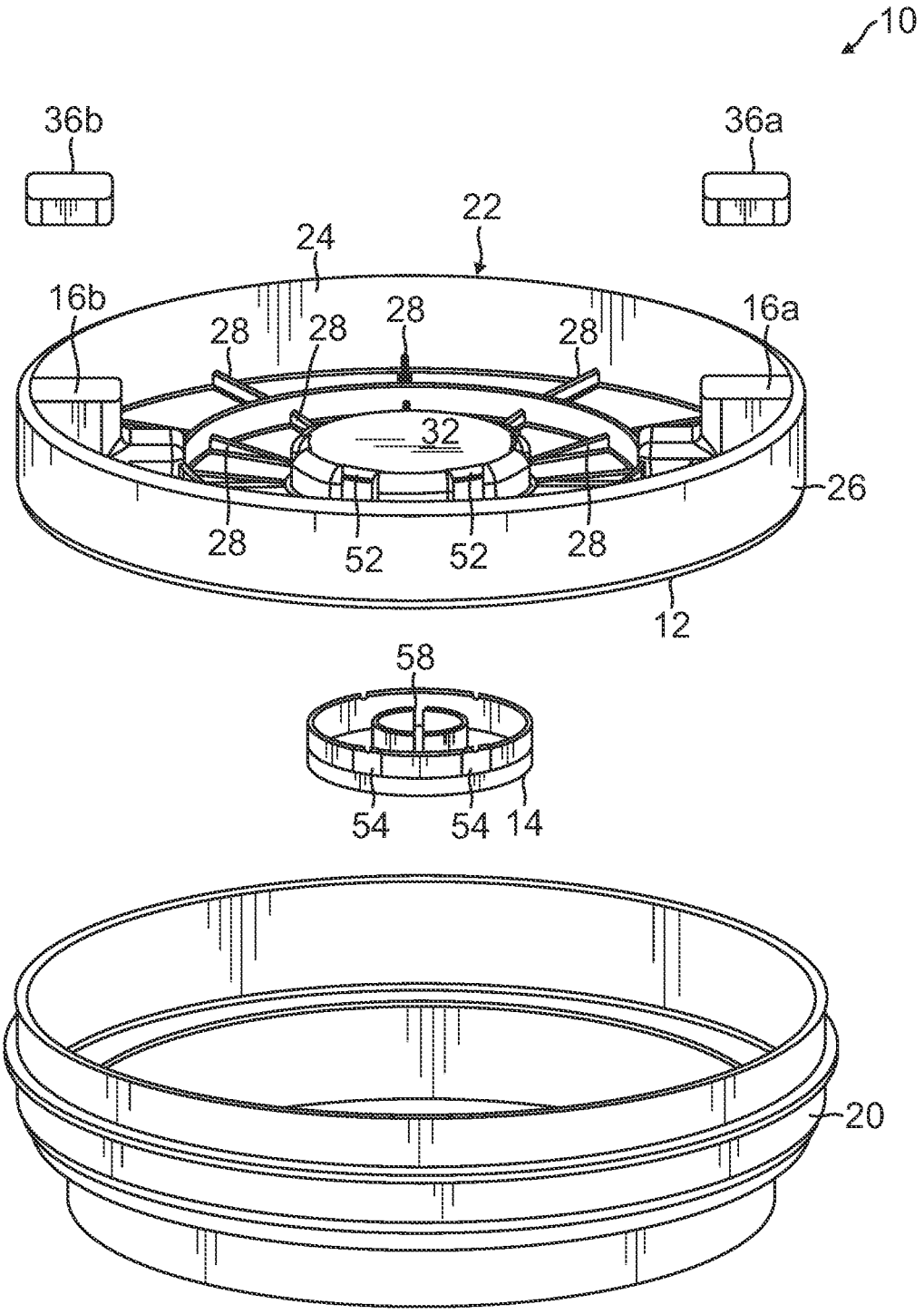
FIG. 11 is a side exploded view of the convertible lid assembly of the instant invention with the non-fill side face up and unfilled, showing also the optional center tab/logo plate.

When included in the assembly, the center tab/logo plate 14 can include a logo 38 or it can include some other type of decorative look or include nothing at all. When included, there is a recess 34 on the non-fill side 12 which extends into the fill side 22 where the underside 32 protrudes into the cavity 24. A center ridge 58 is located in the center recess 34 in relation to the rest of the cover and provides orientation of the center tab/logo plate 14 relative to the finger holes 16*a*, 16*b* and or the orientation to the perimeter shape. This center ridge 58 fits into a corresponding slot 102 in the center tab/logo plate 14. See FIGS. 11 and 12. Along the perimeter of the recess 34 are one or more windows 52 that are recessed perpendicular to the lid recess 34 and allow for the mating with tabs 53 found around the perimeter sidewall of the tab/logo plate 14. When the tab/logo plate 14 is fitted into the recess 34, the tabs 53 on the center tab/logo plate 14 align with a corresponding window 52 where they are secured into place by an undercut 48 on the corresponding window 52. (See FIG. 12).

Figure 12:
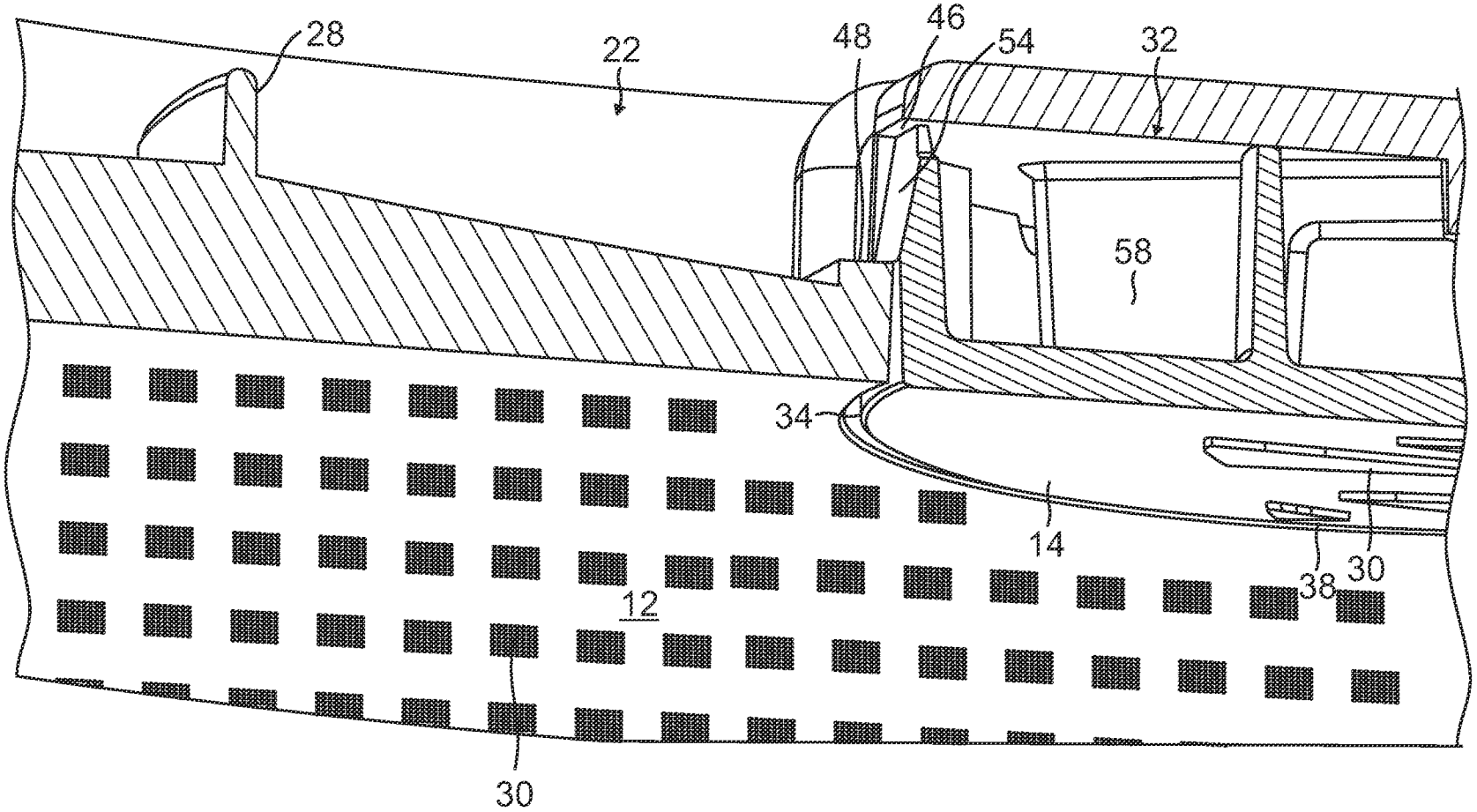
FIG. 12 is a side cross-sectional view of a section of the optional center tab/logo plate portion of the convertible lid assembly of the instant invention showing where the optional center tab/logo portion sets into the receiving portion of the convertible lid assembly and also showing textured sections.
Figure 13A:
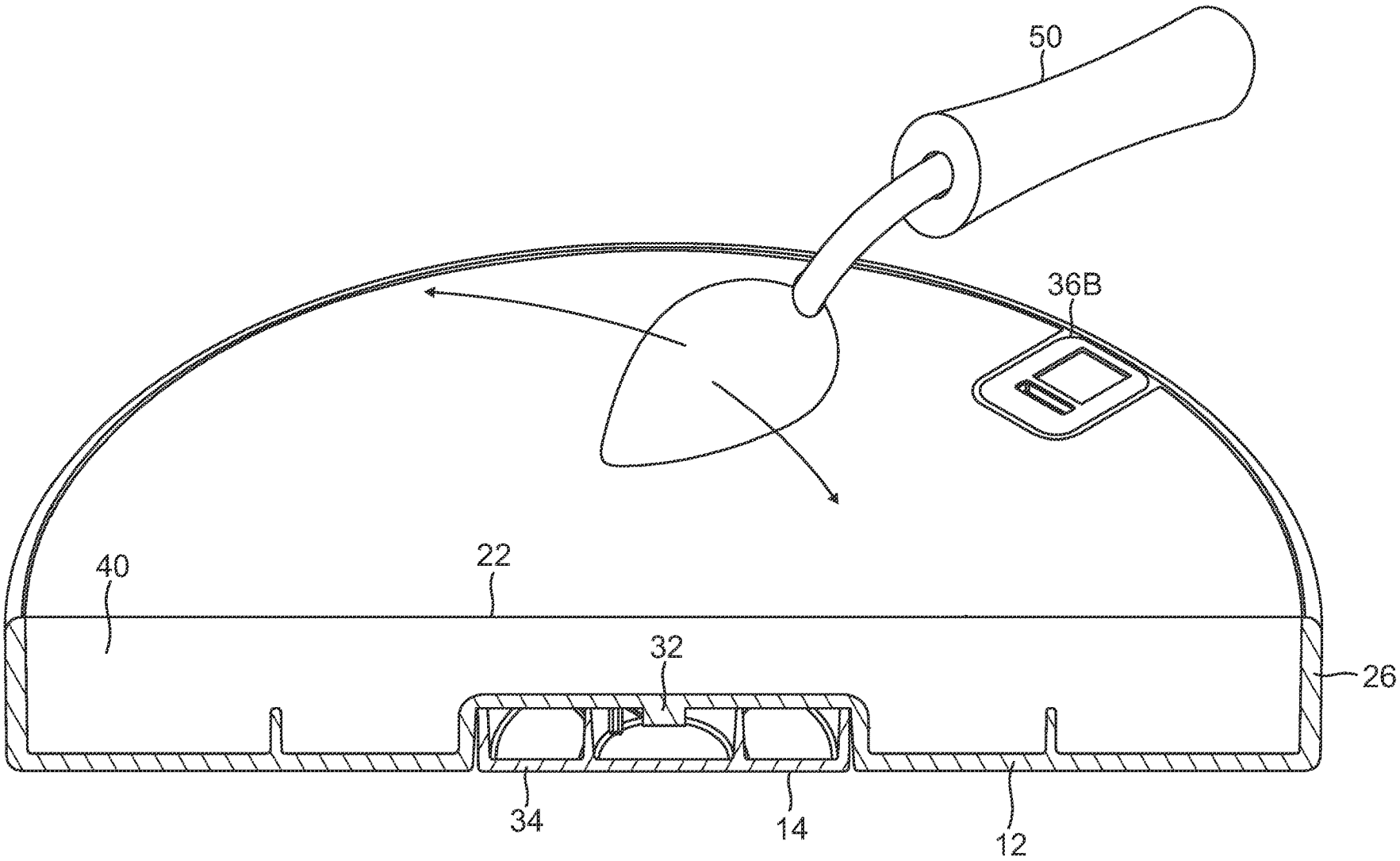
FIG. 13A is a tilted cross-sectional side view of the convertible lid assembly of the instant invention with the fill-side facing up and being filled with fill material to match or coordinate with the deck material of a pool deck.
Figure 13B:
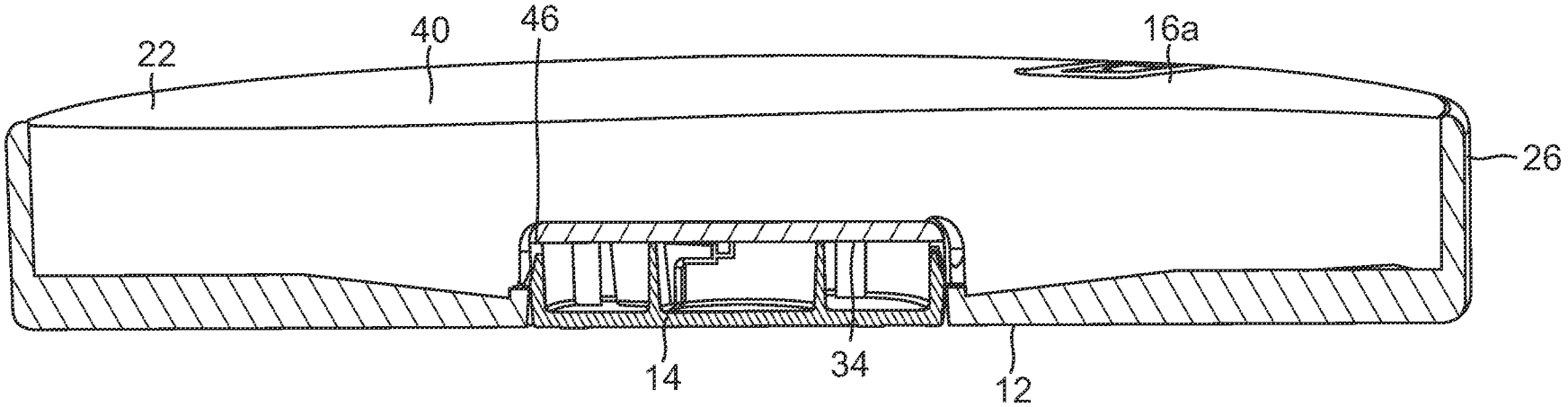
FIG. 13B is a side cross-sectional side view of the convertible lid assembly of the instant invention with the fill-side facing up and having been filed with fill material.
Figure 14:
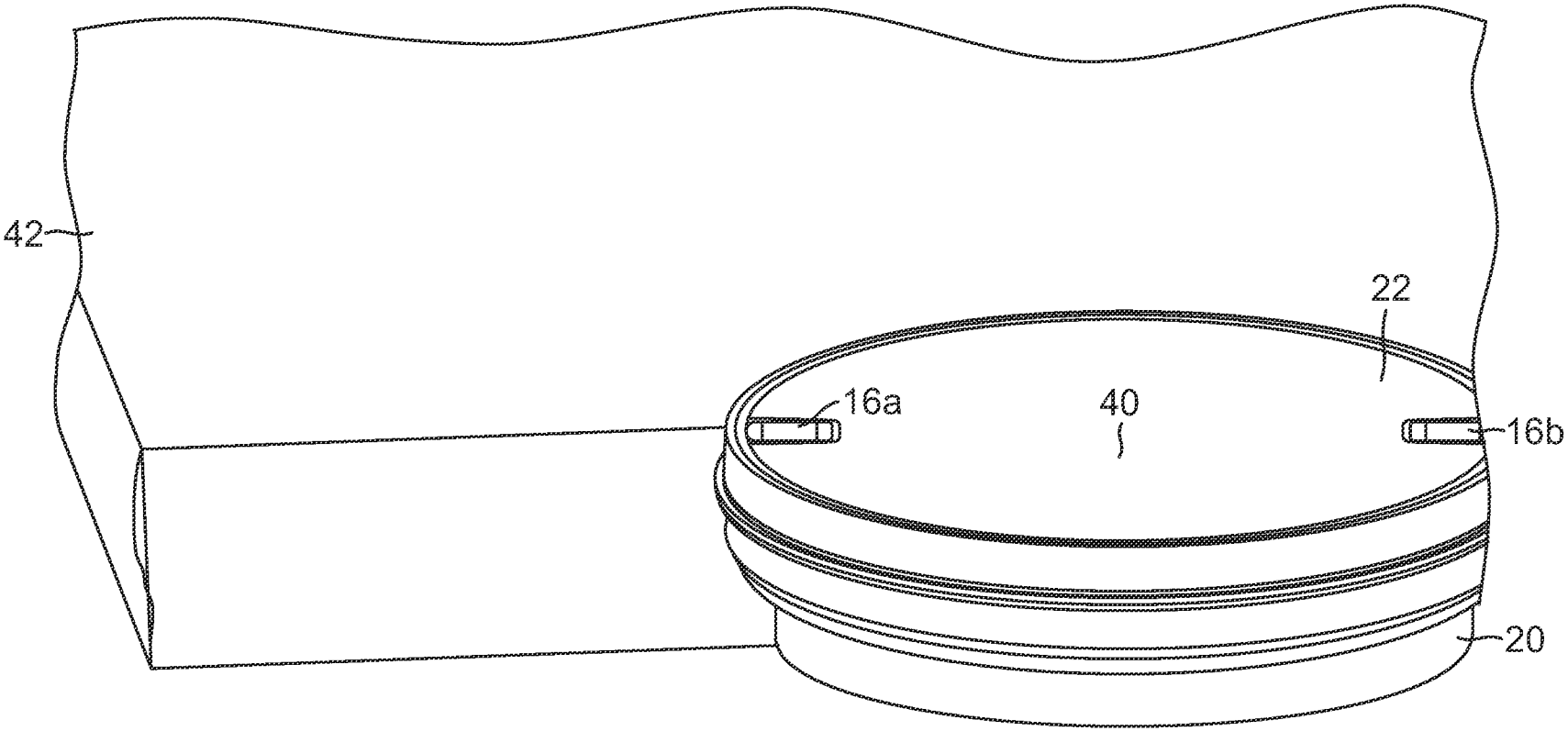
FIG. 14 is a top perspective, partially cross-sectional view of the convertible lid assembly of the instant invention showing the non-fill side installed and filled to match and/or coordinate with the material of the pool deck.

Another undercut 46 in the recessed portion 34 provides for a catch of fill material when the fill side 22 is elected for use. Another undercut 54 is provided by the center tab/logo plate 14 for the same purpose. As the cavity 24 is filled with the fill material, the fill material also fills the cavity created by the undercut 46, which prevents the fill material from lifting back out. These undercuts are seen in FIG. 12. Alternate undercuts may be employed if the optional tab/logo plate and accompanying recessed portion 34 are not employed. As an example, a rib or wall segment extending from the wall forming the finger hold 60 that extends inward into the lid cavity toward the center of lid may act as an alternate undercut.

Figure 9A:
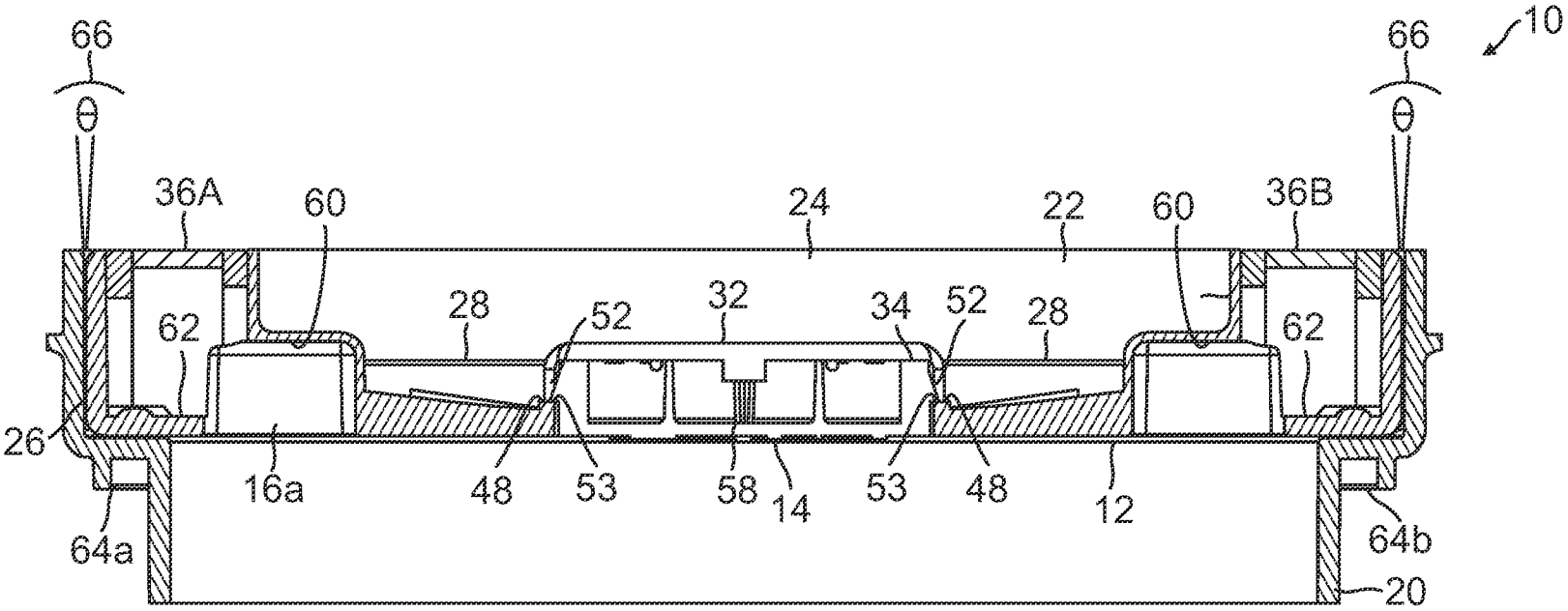
FIG. 9A is a side cross-sectional view of the convertible lid assembly of the instant invention with the fill side facing up.
Figure 9B:
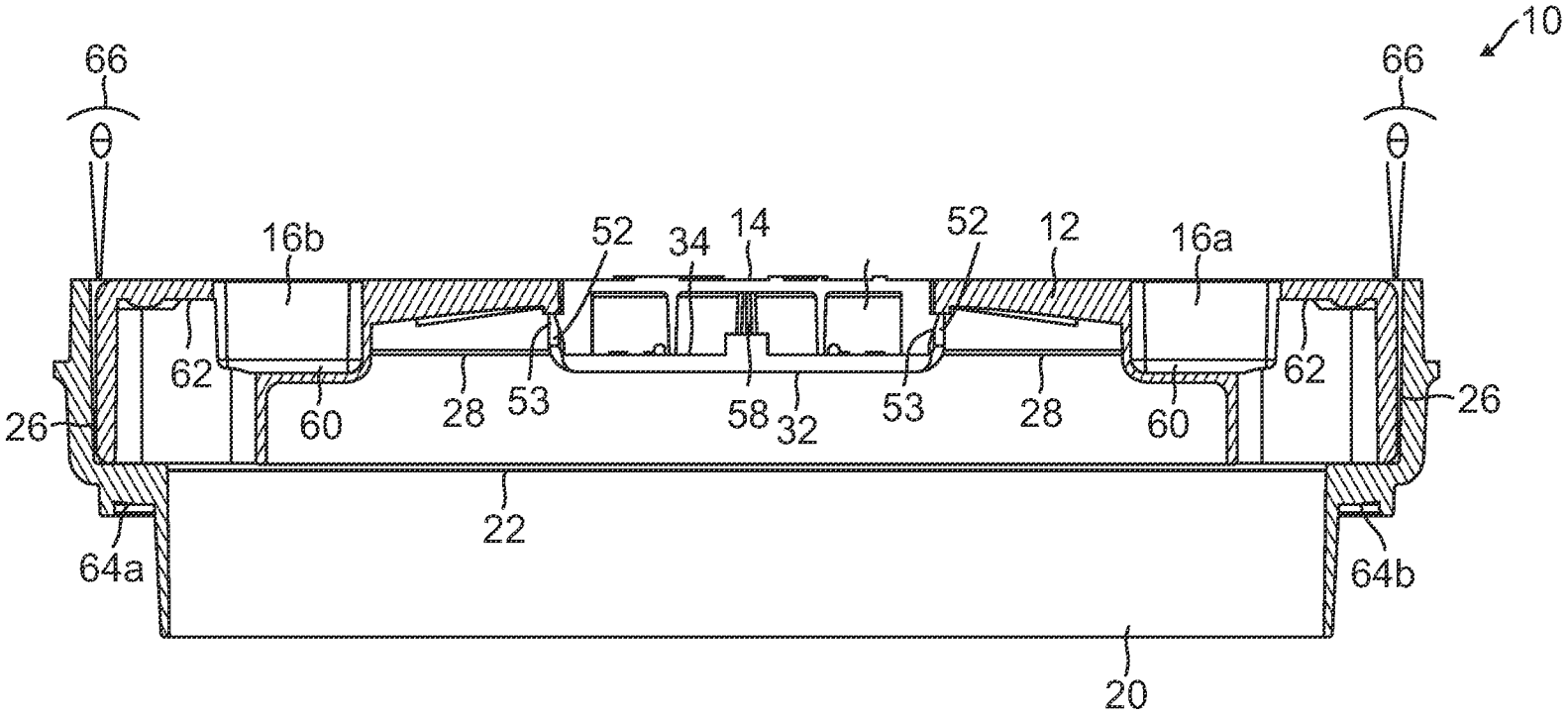
FIG. 9B is a side cross-sectional view of the convertible lid assembly of the instant invention with the non-fill side facing up.

FIG. 9A shows a side cross-sectional view of the assembly 10 with the fill side 22 face up. In this orientation, the finger holes 16*a*, 16*b* include temporary covers 36*a*, 36*b* that cover the holes when being filled to prevent the finger holes 16*a*, 16*b* from being filled with the fill material 40. Once filled, these removable covers 36*a*, 36*b* can be removed and discarded, revealing the finger holes 16*a*, 16*b* for use as needed. The removable covers 36*a*, 36*b* can be popped off with a screwdriver or they can be pushed out from the opposite side. They easily wedge in and out of place for use and then for discarding.

Figure 15:
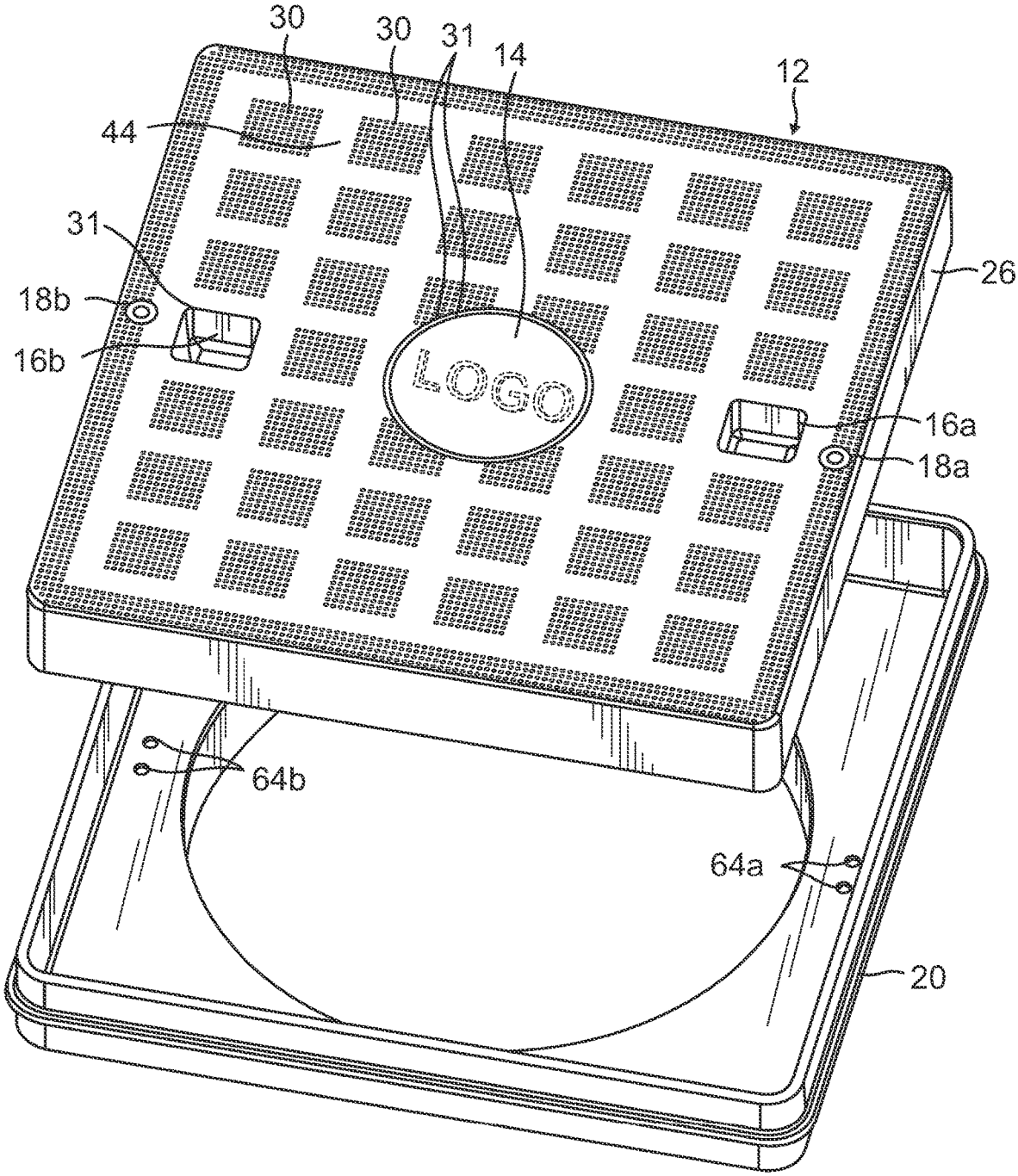
FIG. 15 is an exploded view of the square-shaped embodiment of the convertible lid assembly of the instant invention showing the non-fill side facing up and showing the textured non-slip portions and including the optional center tab/logo plate.

As previously noted, the shape of the assembly 10 can be round, square, oval or any other suitable shape. A square-shaped embodiment is illustrated in FIG. 15. In this embodiment, the mounting ring 20 is also square shaped so that the mounting ring 20 can receive the side wall 26 of the assembly 10. When the square shaped embodiment is used, there are two receiving holes 64*a*, 64*b* on either side of the mounting ring 20 to correspond to the position of the screw holes 18*a*, 18*b* on the non-fill side 12 of the assembly lid. The existence of two receiving holes will allow for when the screw hole 18*a*, 18*b* to be in alignment with the finger holes 64*a*, 64*b* depending on the orientation of the lid, i.e., which side is being used.

Another distinguishing feature is illustrated in FIG. 15, which is a non-skid/non-slip surface, including the textured surface and other non-slip features that prevent slips on the pool deck. As shown, clusters of textured raised portions 30 are found along the surface and separated by a minimal distance 44 from each other, i.e., no more than 1" apart, except in the locations 31 where the finger holes are located, the perimeter of the finger holes providing its own grip, thereby providing a minimum amount of textured raised portions 30 in close proximity to each other that allows for a non-skid surface along the top of the pool deck, including the portion covered by the convertible lid assembly 10. An alternative to the textured raised portions 30 are embossed features and their bounding edges, such as the intersection of the lid and the optional center tab/logo plate and the intersection of the lid and the finger hole, that act as gripping surface to prevents a person from slipping on the pool deck. These alternate embossed features may be taken into account in relation the textured raised portions 30 in the maximum spacing of 1" apart between texture features.

Figure 16:
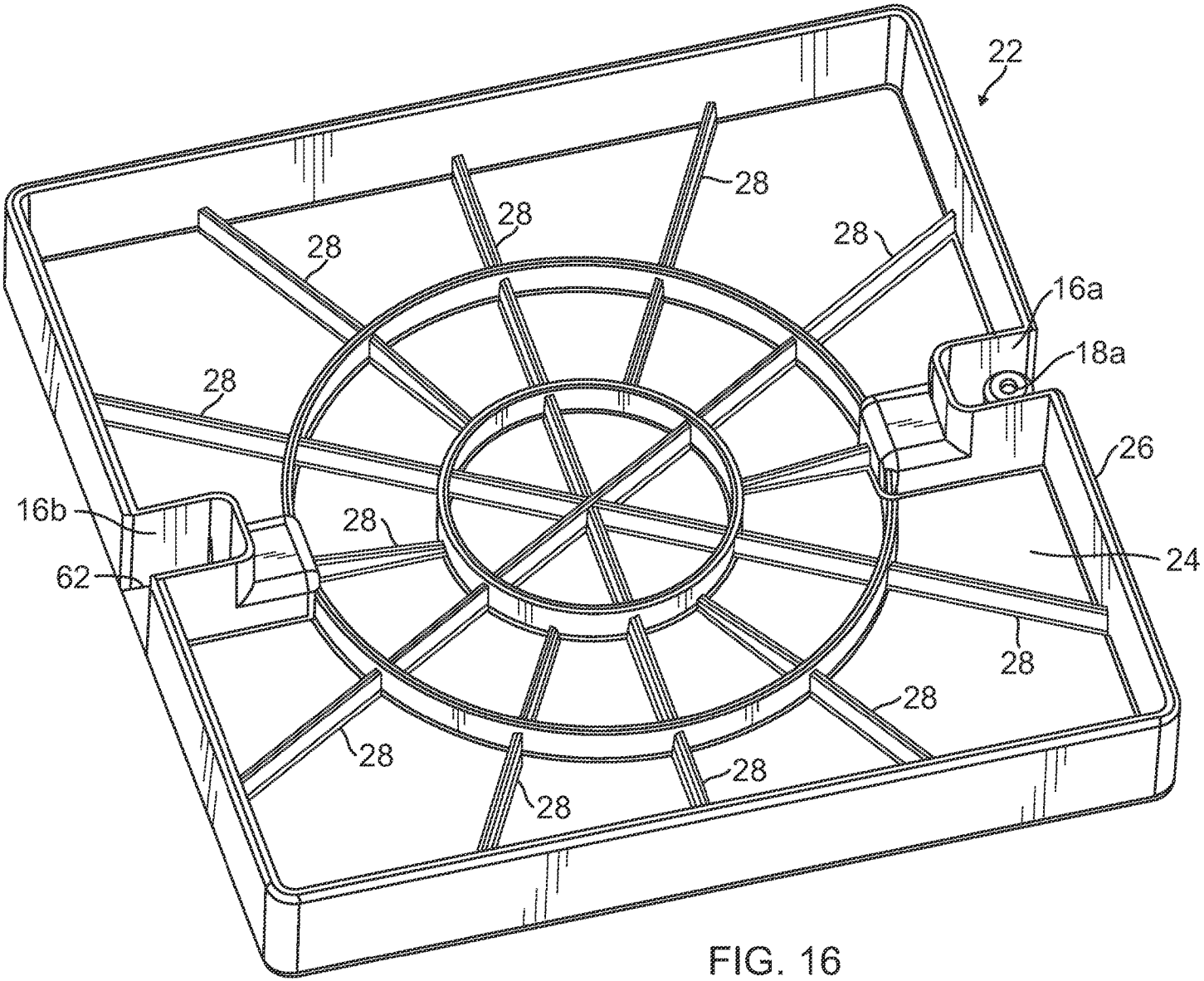
FIG. 16 is a bottom view of a square-shaped embodiment with side finger holes that interrupts the continuity of the sidewalls showing the fill side unfilled.
Figure 17:
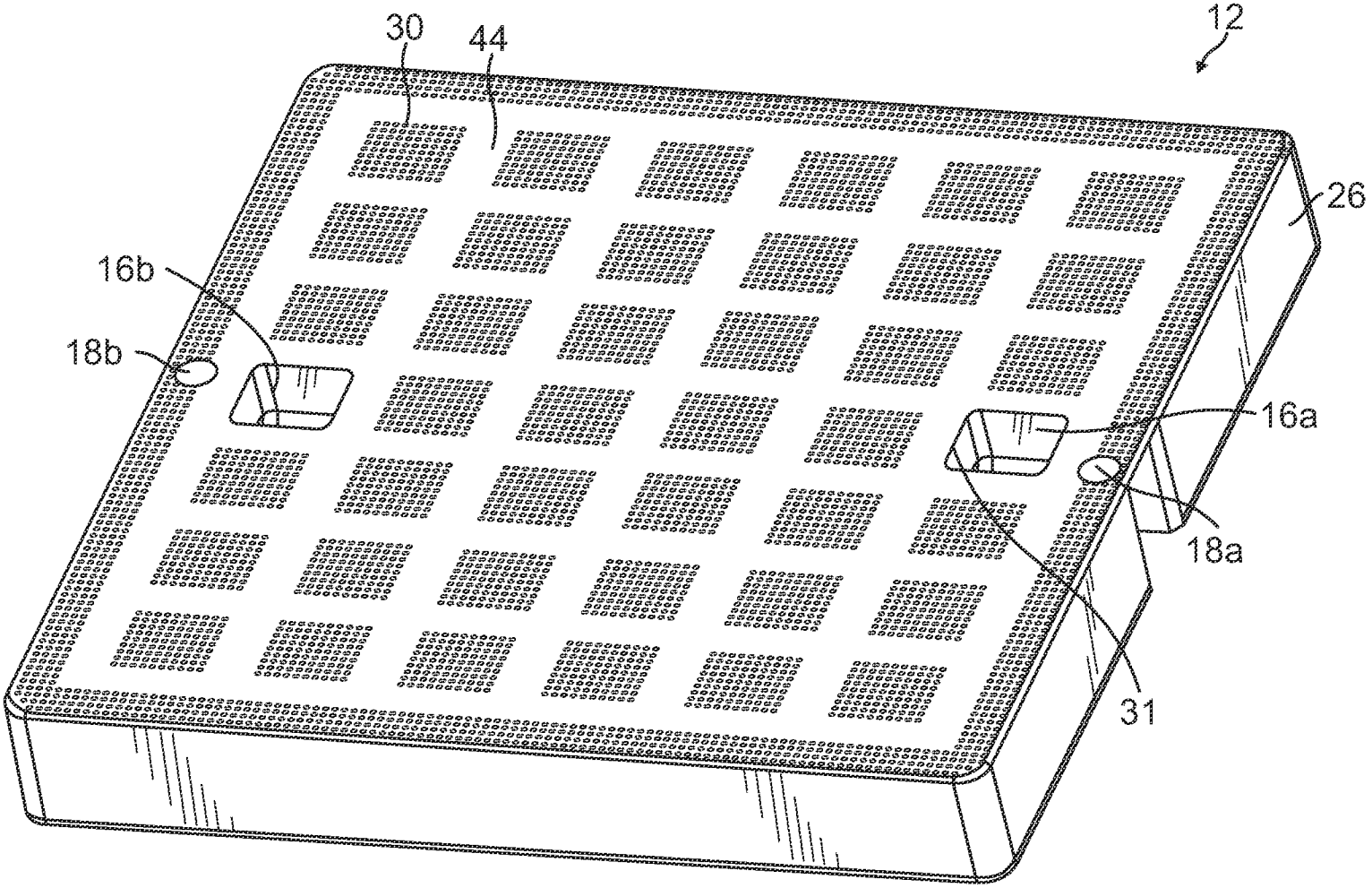
FIG. 17 is a top perspective view of the square-shaped embodiment of the convertible lid assembly of the instant invention showing the non-fill side with textured portions without the optional center tab/logo plate.

FIGS. 16-17 show two embodiments with side finger holes 16 that interrupt the continuity of the sidewalls 26. The walls of the finger holes 16 supplement the interrupted sidewalls 26 to maintain a functional fill side cavity 24. The sidewalls 26 in other embodiments are otherwise continuous around their perimeters. The sidewalls also should maintain their minimal taper angle 66 relative to the hole they are being placed in regardless of the orientation of the lid.

Figure 18:
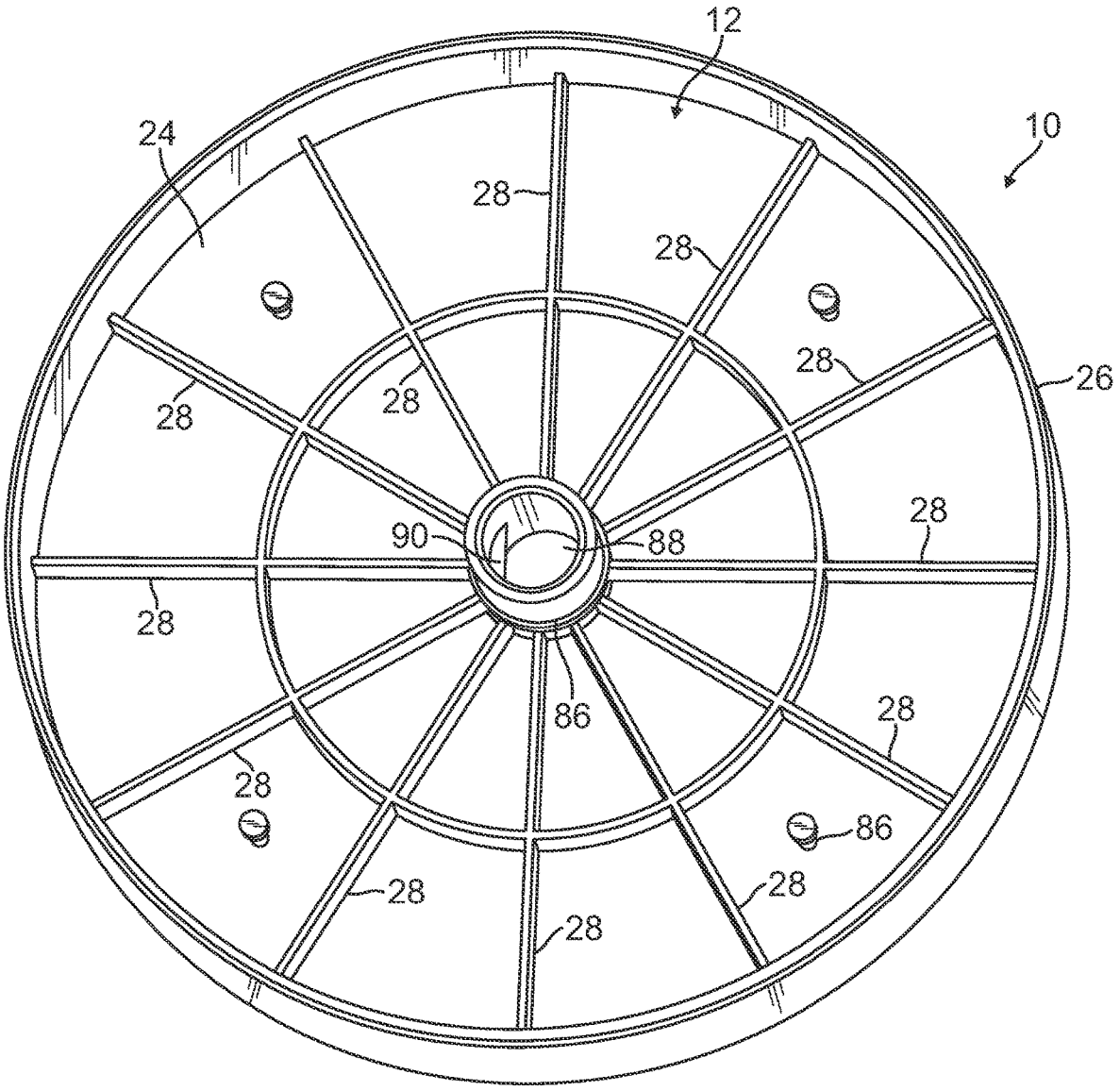
FIG. 18 is a top view of the fill side of a round-shaped embodiment with a center finger hold and undercut flanges throughout the lid.
Figure 19:
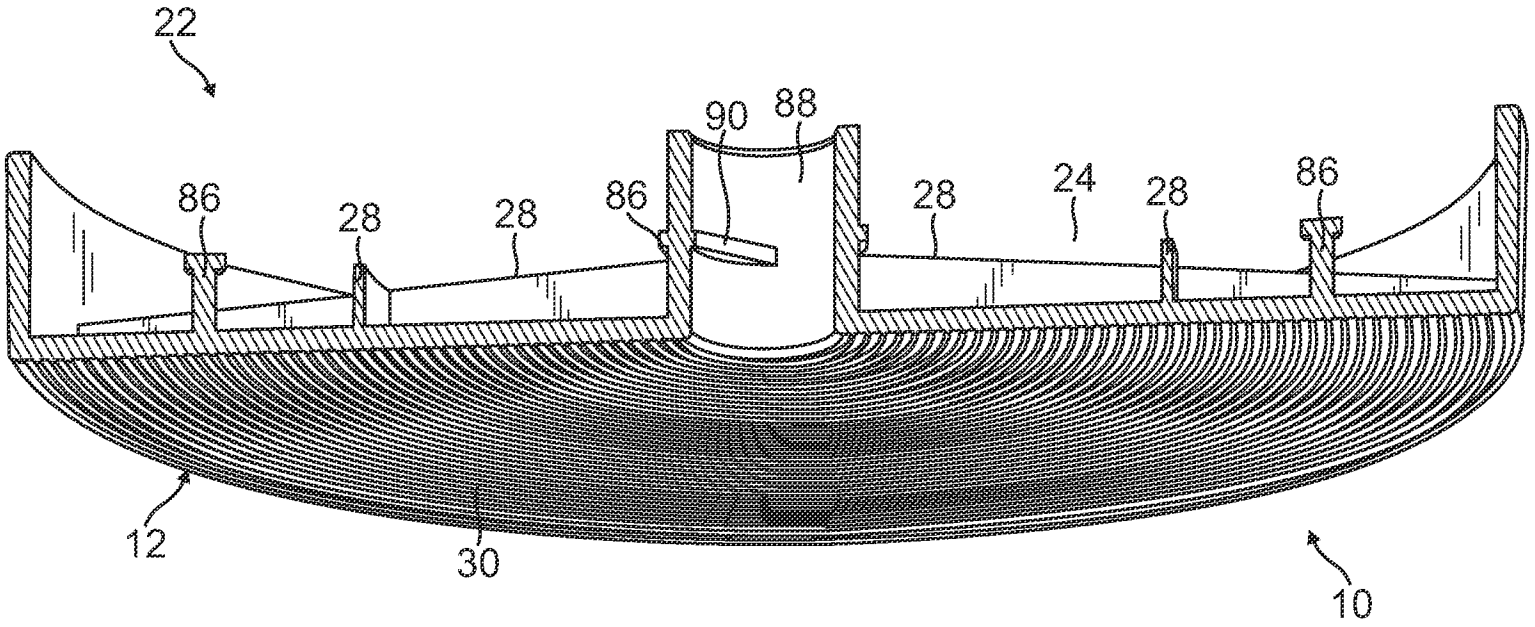
FIG. 19 is a bottom side cutaway view of a round-shaped embodiment with textured surface with the center finger hold and plurality of undercut flanges.
Figure 20:
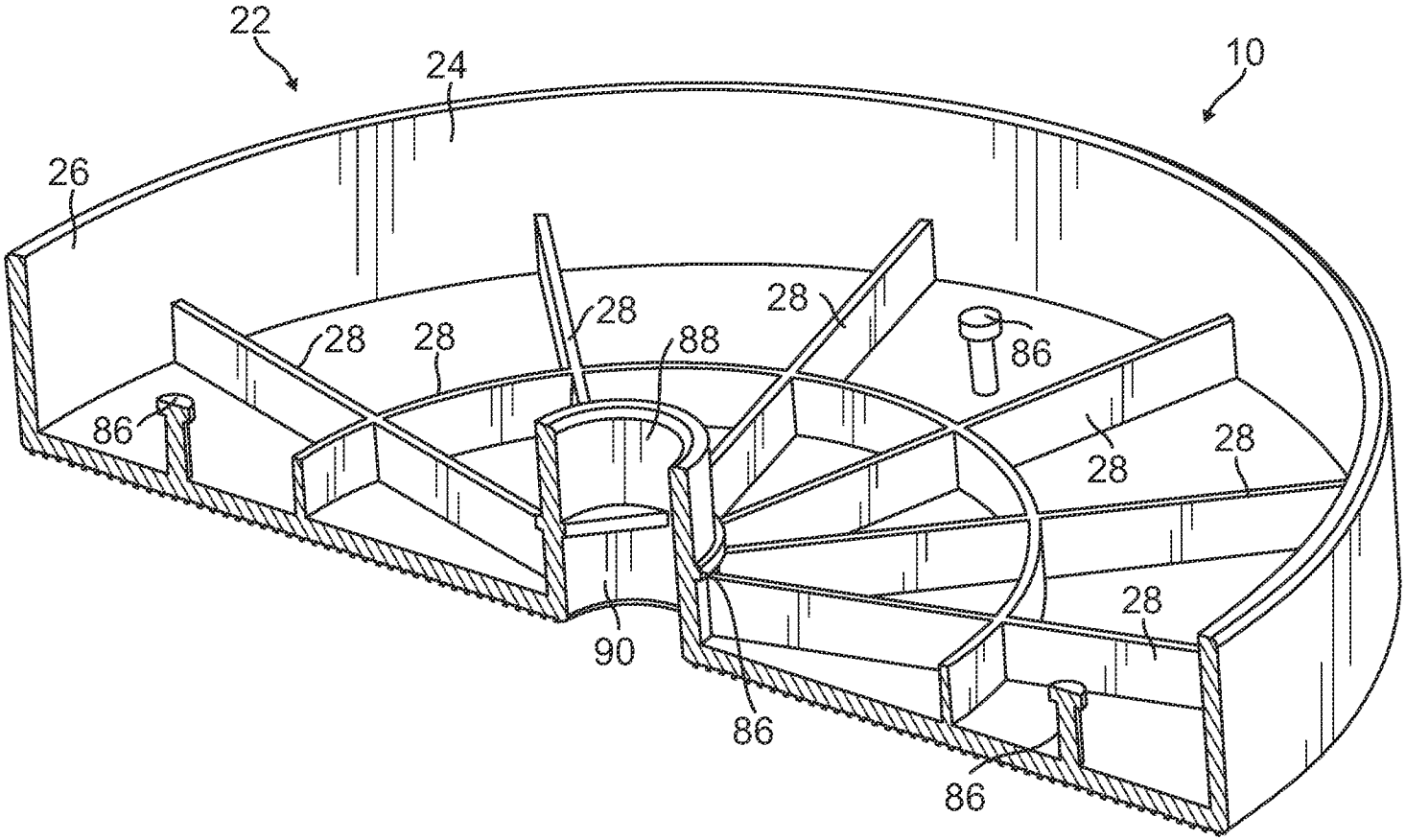
FIG. 20 is a top side cutaway view of the round-shaped embodiment shown in FIG. 19.

FIGS. 18-20 illustrate an alternate embodiment in that the finger hold 90 is found in the center hole 88 of the lid 10. The center hole 88 is substantially circular and the finger hold 90 is notched across a portion of the center of the hole to provide a surface for a user to grip with his or her finger to lift the lid. Also shown in these figures are a plurality of undercut flanges 86 that allow for integrity when the fill side is filled with material. These flanges 86 perform the same function as the flanges 46 defined in prior embodiments but are structurally different in this embodiment.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A convertible lid assembly for pool deck apertures comprising:

a convertible lid, said convertible lid further comprising:

a first non-fillable side, said first non-fillable side further comprising:

a center point;

a substantially planar surface having a perimeter;

a sidewall extending downward from said perimeter substantially perpendicular to said planar surface; and a non-slip surface;

a second fillable side having a common perimeter with said first non-fillable side, said fillable side further comprising:

a common perimeter with said first non-fillable side;

a common center point with said first non-fillable side;

a plurality of ribs to support said first non-fillable side wherein said sidewall has a consistent height around said perimeter to contain a fill material therein;

a mounting ring with a common perimeter with said first non-fillable side and said second fillable side into which said sidewall seats wherein said mounting ring is configured for permanent placement in said pool deck aperture through pool deck material wherein said convertible lid is configured to removably cover said pool deck aperture.

2. The convertible lid assembly as defined in claim 1 wherein said first non-fillable side and second fillable side of said lid further comprise one or more retaining apertures for use with one or more retaining screws and wherein said mounting ring further comprises one or more apertures corresponding to said one or more retaining apertures in said first non-fillable side or said second fillable side for securing said lid with said one or more retaining screws.

3. The convertible lid assembly as defined in claim 2 wherein each of said one or more retaining apertures on said first non-fillable side interconnects to a respective one or more retaining apertures on said second fillable side each interconnected retaining aperture configured for use with one or more retaining screws to be used and accessed from either said first non-fillable side or said second fillable side of said convertible lid for attachment to said mounting ring.

4. The convertible lid assembly as defined in claim 3 wherein said one or more retaining apertures are configured such that said one or more retaining screws will have equal engagement with said one or more apertures in said mounting ring when said one or more retaining screws are installed from said first non-fillable side of said convertible lid or when said one or more retaining screws are installed from said second fillable side of said convertible lid.

5. The convertible lid assembly as defined in claim 1 wherein said second fillable side has at least one undercut to retain a fill material in said convertible lid.

6. A convertible lid assembly for pool deck apertures comprising:

a convertible lid, said convertible lid further comprising:

a first non-fillable side, said first non-fillable side further comprising:

a center point;

a substantially planar surface having a perimeter;

a sidewall extending downward from said perimeter substantially perpendicular to said planar surface;

one or more apertures to be used as finger holes; and a non-slip surface;

a second fillable side, said second fillable side further comprising:

a common perimeter with said first non-fillable side;

a common center point with said first non-fillable side;

a sidewall with a consistent height to contain a fill material; and one or more apertures to be used as finger holes;

a mounting ring with a common perimeter with said first non-fillable side and said second fillable side into which said sidewall seats wherein said mounting ring is configured for permanent placement in said pool deck aperture through pool deck material wherein said convertible lid is configured to removably cover said pool deck aperture.

7. The convertible lid assembly as defined in claim 6 wherein said first non-fillable side of said convertible lid further comprises one or more retaining apertures and wherein said mounting ring further comprises one or more apertures corresponding to said one or more retaining apertures on said first non-fillable side and said second fillable side for securing said convertible lid with said one or more retaining screws.

8. The convertible lid assembly as defined in claim 7 wherein each of said one or more retaining apertures on said first non-fillable side interconnects to a respective one or more retaining apertures on said second fillable side each said interconnecting retaining aperture configured for use with one or more retaining screws to be used and accessed from both said first non-fillable side and said second fillable side of said convertible lid for attachment to said mounting ring.

9. The convertible lid assembly as defined in claim 8 wherein said one or more of said one or more retaining apertures are usable from both said first non-fillable side and said second fillable side of the lid and are designed so said one or more screws will have substantially equal engagement with said one or more apertures in said mounting ring when said one or more retaining screws are installed from said first non-fillable side or when said one or more retaining screws are installed from said second fillable side of said convertible lid.

10. The convertible lid assembly as defined in claim 6 wherein each of said one or more apertures are to be used as finger holes on said first non-fillable side of said convertible lid and is interconnected to a respective aperture to be used as a finger hole on said second fillable side.

11. The convertible lid assembly as defined in claim 10 wherein one or more finger holds corresponding to said one or more interconnected apertures are to be used as finger holes wherein at least one of said one or more finger holds are for use from said first non-fillable side.

12. The convertible lid assembly as defined in claim 10 wherein one or more finger holds corresponding to said one or more interconnected apertures are to be used as finger holes wherein at least one of said one or more finger holds are for use from said second fillable side.

13. The convertible lid assembly as defined in claim 10 wherein one or more finger hold features corresponding to said one or more interconnected apertures are to be used as finger holes wherein at least one of said one or more finger hold features are for use from said first non-fillable side and said second fillable side.

14. The convertible lid assembly as defined in claim 6 wherein said second fillable side has at least one undercut to retain a fill material to said convertible lid.

15. A convertible lid assembly for pool deck apertures comprising:

a convertible lid, said convertible lid further comprising:

a first non-fillable side, said first non-fillable side further comprising:

a center point;

a substantially planar surface having a perimeter;

a sidewall extending downward from said perimeter substantially perpendicular to said planar surface;

one or more apertures to be used as finger holes; and a non-slip surface;

a second fillable side, said second fillable side further comprising:

a common perimeter with said first non-fillable side;

a common center point with said first non-fillable side;

a plurality of ribs to support said first non-fillable side;

a sidewall with a consistent height to contain a fill material;

one or more apertures to be used as finger holes each of said one or more apertures to be used as finger holes in said second fillable side interconnects to a respective one or more apertures to be used as the finger holes on said first non-fillable side of the lid said one or more apertures to be used as finger holes on said second fillable side of said convertible lid has an entrance height at a same common height as said perimeter side wall;

at least one undercut to retain a fill material to the lid; and a mounting ring with a common perimeter with said first non-fillable side and said second fillable side into which said sidewall seats wherein said mounting ring is configured for permanent placement in said pool deck aperture through pool deck material wherein said convertible lid is configured to removably cover said pool deck aperture.

16. The convertible lid assembly as defined in claim 15 wherein said first non-fillable side and said second fillable side of said convertible lid further comprising one or more retaining apertures for one or more retaining screws wherein said mounting ring further comprises one or more apertures corresponding to said one or more retaining apertures in said first non-fillable side and said second fillable side for securing said convertible lid with said one or more retaining screws, each of said one or more retaining apertures on SAID first non-fillable side interconnects to a respective one or more retaining apertures on SAID second fillable side, each interconnected retaining aperture configured for use with one of said one or more retaining screws to be used and accessed from both said first non-fillable side or said second fillable side of said convertible lid for attachment to said mounting ring.

17. The convertible lid assembly as defined in claim 16 wherein said one or more retaining apertures are at least partially located within said interconnected finger holes wherein said one or more retaining apertures are designed so said one or more screws will have substantially equal engagement with said one or more apertures in said mounting ring when said one or more retaining screws are installed from said first non-fillable side or when said one or more retaining screws are installed from said second fillable side of said convertible lid.

18. The convertible lid assembly as defined in claim 15 wherein one or more finger hold features corresponding to said one or more interconnected apertures are to be used as finger holes.

19. The convertible lid assembly as defined in claim 15 wherein a taper angle between said sidewall of said convertible lid and said common perimeter of said mounting ring is between zero and twelve degrees when either said first non-fillable side or said second fillable side of said convertible lid is viewable from said pool deck while located within said mounting ring.

20. The convertible lid assembly as defined in claim 15 wherein said non-slip surface of said first non-fillable side of said convertible lid employs individual non-slip features with no more than one inch spacing therebetween.

21. The convertible lid assembly as defined in claim 15 wherein said first non-fillable side of said convertible lid is receives a logo plate.

22. The convertible lid assembly as defined in claim 21 wherein said convertible lid is configured for the selection of said second fillable side wherein said logo plate substantially closes off windows in said convertible lid assembly to prevent fill material from migrating through said windows and falling out of said convertible lid during a filling process.

23. The convertible lid assembly as defined in claim 15 wherein said second fillable side of said convertible lid has a minimum depth of six hundred thousandths of an inch as measured from a distal end of said sidewall opposite said planar surface.

* * * * *